US005841448A

United States Patent [19]

Moriyama et al.

[11] Patent Number: 5,841,448

[45] Date of Patent: Nov. 24, 1998

[54] SUBSTRATE FOR INK-JET HEAD, HAVING AN OPTICAL ELEMENT INK-JET HEAD, AND INK-JET APPARATUS

[75] Inventors: Jiro Moriyama, Kawasaki; Sadayuki Sugama, Tsukuba; Hiromitsu Hirabayashi, Yokohama; Hiroshi Tajika, Yokohama; Noribumi Koitabashi, Yokohama; Yuji Akiyama, Yokohama; Yoshiyuki Imanaka, Yokohama; Masaaki Izumida, Kawasaki, all of Japan

[73] Assignee: Canon Kabushiki Kaishi, Tokyo, Japan

[21] Appl. No.: 365,024

[22] Filed: Dec. 28, 1994

[30] Foreign Application Priority Data

Dec. 28, 1993 [JP] Japan ..... 5-336704
Dec. 27, 1994 [JP] Japan ..... 6-324402

[51] Int. Cl.[6] ..... B41J 29/393; B41J 2/195

[52] U.S. Cl. ..... 347/19; 347/7; 347/14; 347/59; 347/17

[58] Field of Search ..... 347/7, 17, 19, 347/59, 58, 67

[56] References Cited

U.S. PATENT DOCUMENTS

| | | | |
|---|---|---|---|
| 4,894,667 | 1/1990 | Moriyama | 347/68 |
| 4,947,194 | 8/1990 | Kyoshima | 347/67 |
| 5,006,867 | 4/1991 | Koizumi et al. | 347/17 |
| 5,023,630 | 6/1991 | Moriyama | 347/68 |
| 5,148,192 | 9/1992 | Izumida et al. | 347/44 |
| 5,164,747 | 11/1992 | Osada et al. | 347/19 |
| 5,166,699 | 11/1992 | Yano et al. | 347/17 |
| 5,175,565 | 12/1992 | Ishinaga et al. | 347/67 |
| 5,221,931 | 6/1993 | Moriyama | 347/10 |
| 5,367,325 | 11/1994 | Yano et al. | 347/17 |
| 5,371,528 | 12/1994 | Izumida et al. | 347/87 |

FOREIGN PATENT DOCUMENTS

| | | | |
|---|---|---|---|
| 0444861 | 9/1991 | European Pat. Off. . | |
| 0573274 | 12/1993 | European Pat. Off. | 347/7 |
| 4203294 | 8/1993 | Germany . | |
| 62-156963 | 7/1987 | Japan . | |

*Primary Examiner*—Benjamin R. Fuller
*Assistant Examiner*—L. Anderson
*Attorney, Agent, or Firm*—Fitzpatrick, Cella, Harper & Scinto

[57] ABSTRACT

There is disclosed an ink-jet head for performing recording by discharging an ink, including a discharge port for discharging the ink, and an ink channel which communicates with the discharge port and is provided with a discharge energy generating element for discharging the ink. An optical element is arranged at a position, corresponding to the ink channel, of the ink-jet head. There are also disclosed an ink-jet apparatus using the ink-jet head and a substrate for the ink-jet head.

16 Claims, 31 Drawing Sheets

SUBSTRATE FOR INK-JET HEAD, HAVING AN OPTICAL ELEMENT INK-JET HEAD, AND INK-JET APPARATUS

BACKGROUND OF THE INVENTION

1. Field of the Invention

The present invention relates to a liquid-discharge head and a substrate used in a liquid-discharge apparatus for recording (printing) characters and images by discharging a liquid and, more particularly, to a liquid-discharge head having a function element, a substrate used in the head, and a liquid-discharge apparatus using this. Note that "recording" includes provision of an ink to recording media such as cloth, thread, paper, sheet member, leather, and the like independently of the presence/absence of the meaning of an image to be recorded.

2. Related Background Art

An ink-jet apparatus which uses an ink as a liquid to be discharged is widely used due to its easy operability.

Such an ink-jet apparatus has an ink-jet head (FIG. 40) for discharging an ink droplet, and an ink tank IT which stores an ink to be supplied to the ink-jet head. The ink-jet head has discharge ports for discharging an ink, ink channels which communicate with the discharge ports and are provided with discharge energy generating elements (heating elements, piezoelectric elements, or the like) used for discharging an ink, and a substrate on which the discharge energy generating elements are arranged.

In the ink-jet apparatus, when an ink is used up during recording, the recording operation is disabled. In this case, since an unrecordable state appears as an image on a recording medium, most of conventional ink-jet apparatuses do not detect ink shortage in terms of, e.g., cost.

A method adopted in an apparatus with an arrangement for electrically detecting ink shortage has two electrodes in the ink tank, and detects the presence/absence of an ink on the basis of a change in electrical resistance between the electrodes. Alternatively, an optical sensor is arranged in the vicinity of the ink tank, and the presence/absence of an ink in the ink tank is detected on the basis of a change in transmittance of light in the ink tank.

On the other hand, when an ink-jet apparatus for performing recording by discharging an ink is left unused for a long period of time without performing recording, the density of an ink undesirably changes, and stable ink discharge cannot be attained.

In the above-mentioned ink-jet head shown in FIG. 40, bubbles are often generated and grow in ink channels 306 and an ink reservoir 305 upon supply of an ink from the ink tank to the discharge ports. When the bubbles move upon refilling of an ink and reach discharge ports 302, a discharge error called an ink omission and a print error as a dot omission on a printed result occur although some ink still remains in the ink tank. Such a print error due to a discharge error impairs the quality of an image. When an image is to be reprinted, a print error results in a time loss and waste of paper sheets. Also, the head is damaged, and print quality deteriorates.

As a countermeasure against this print error, an automatic recovery operation for drawing an ink by suction from the discharge ports is periodically performed before printing, thereby preventing ink omissions. However, in this case, since an ink is periodically drawn by suction from the discharge ports, the ink is undesirably drawn by suction even when it is not subjected to a discharge error, and the amount of ink which does not contribute to printing increases unnecessarily. As a result, running cost per sheet increases very much. The drawn ink is stocked in a printer main body, and this drawn ink reservoir disturbs a compact, lightweight structure of the apparatus.

Of the substrate constituting the above-mentioned ink-jet head, as a substrate using heating elements as discharge energy generating elements, the following substrate has been developed. That is, an array of a plurality of heating elements, drivers for driving the heating elements in accordance with image data in one-to-one correspondence with the heating elements, a shift register which has the same number of bits as the heating elements and parallelly outputs serially inputted image data to the drivers, and a latch circuit for temporarily storing data outputted from the shift register are arranged on a single circuit board. The print head substrate arranged on the single circuit board is constituted by forming the heating elements on an IC which includes bipolar transistors called Bi-CMOS transistors and C-MOS transistors formed on a silicon substrate.

FIG. 41 is a circuit diagram showing an internal equivalent circuit of the head using the print head substrate. Referring to FIG. 41, the circuit includes an array of heating elements 101, power transistors 102, a latch circuit 103, a shift register 104, a clock generator 105 for operating the shift register, an image data input portion 106, a heat pulse width input portion 107 for externally controlling the ON times of the power transistors 102, a logic power supply 108, a GND 109, and a heating element driving power supply (VH) 110.

In a printer having this head, image data is serially inputted from the image data input portion 105 to the shift register 104. The input data is temporarily stored in the latch circuit 103. During this interval, when heat pulses are inputted from the heat pulse width input portion 107, the power transistors 102 are turned on, and the heating elements 101 are driven. Ink portions in the ink channels of the driven heating elements 101 are heated, and are discharged from the discharge ports, thus achieving a print operation.

FIG. 42 is a sectional view of the print head substrate.

A dopant such as As is doped in a p-type Si substrate 201 by, e.g., ion-implantation and diffusion means to form an n-type buried layer 202, and an n-type epitaxial layer 203 is formed thereon. Furthermore, an impurity such as B is doped in the layer 203 to form a p-type well region 204. Thereafter, photolithography, oxidation diffusion, and impurity doping such as ion implantation are repeated to constitute a P-MOS transistor 250 in the n-type epitaxial region and an N-MOS transistor 251 in the p-type well region. Each of the transistors 250 and 251 is constituted by a gate wiring layer 215 of polysilicon deposited by a CVD method via a gate insulating film 208 having a thickness of several hundred Å, and source and drain regions 205 and 206 which are formed by doping an n- or p-type impurity.

The above-mentioned MOS transistors constitute the logic portions 103 and 104.

Each NPN power transistor 252 serving as the driver 102 for the heating element is constituted by a collector region 211, a base region 212, an emitter region 213, and the like in an n-type epitaxial layer by processes such as impurity doping, diffusion, and the like.

The respective elements are isolated by forming an oxide film isolation region 253 by field oxidation. The field oxide film serves as a first heat storage layer under a heat generating element 255.

After the respective elements are formed, an insulating interlayer 216 of PSG or BPSG is deposited by a CVD method, and is flattened by a heat treatment. Thereafter, the elements are electrically connected by a first aluminum electrode layer 217 via contact holes. Thereafter, an insulating interlayer 218 of, e.g., SiO is deposited by a plasma CVD method, and a heater layer 219 and a second aluminum electrode layer 220 are formed via through holes.

A protection layer 221 is obtained by forming an SiN film by a plasma CVD method. As the uppermost layer, an anti-cavitation film 222 of, e.g., Ta is deposited, and has an opening as a pad portion 254.

The power transistor is constituted by a bipolar transistor, but may be formed by a MOSFET.

However, in the above-mentioned prior art, the following problems remain unsolved.

In the above-mentioned sensor using electrodes, the electrode surface deteriorates due to a chemical reaction between the electrodes and an ink especially when the apparatus is not used for a long period of time, thus impairing detection precision. Also, the ink itself may deteriorate, and may impair recording quality.

The method achieved by adding electrodes or other means to the ink tank increases cost since a portion for supplying a detection signal to a recording apparatus in addition to a control signal for controlling recording of the recording head must be added.

In a recording apparatus with an exchangeable ink tank, when an ink in the ink tank is used up, and the ink tank is exchanged with a new one, the detection means added to the ink tank must also be removed, resulting in an increase in running cost.

Even the method achieved by arranging an optical sensor at the recording apparatus side to be located in the vicinity of the ink tank increases cost since a portion for supplying a detection signal to a control circuit of the recording apparatus in addition to a control signal of the recording head must be added.

Furthermore, in the arrangement which is achieved by arranging a remaining ink detection element in the ink tank and detects the presence/absence of an ink, when some ink still remains in the ink tank but cannot be supplied to the recording head due to leakage at a coupling portion or a channel portion between the ink tank portion and the ink head portion, or when bubbles are formed in the channels, as described above, the ink cannot be discharged although a sufficiently amount of ink remains in the ink tank. In this manner, it is impossible to detect an out-of-ink state occurring at the head side of the ink tank.

On the other hand, when recovery processing is periodically performed under the assumption that the density of an ink changes, the ink is wasted when the density of the ink does not change in practice. Also, a change in density of the ink due to a cause other than the above-mentioned case cannot be coped with. In order to achieve a recorded image with higher image quality and higher definition, it is desired to use means for detecting the density of an ink.

SUMMARY OF THE INVENTION

An ink-jet head which solves the above-mentioned problems, comprises:

a discharge port for discharging an ink, and an ink channel which communicates with the discharge port and is provided with a discharge energy generating element for discharging the ink, and wherein an optical element is arranged at a position, corresponding to the ink channel, of the ink-jet head.

An ink-jet apparatus which solves the above-mentioned problems, comprises:

the above-mentioned ink-jet head; and control means for performing at least one of ink remaining amount detection, ink density detection, home position detection, detection of the presence/absence of a recording medium, head temperature detection, and recording medium width detection on the basis of an output from the optical element.

Furthermore, a substrate for the ink-jet head, which solves the above-mentioned problems, comprises:

a discharge energy generating element for discharging an ink;

a wiring electrode electrically connected to the discharge energy generating element; and an optical element.

DETAILED DESCRIPTION OF THE PREFERRED EMBODIMENTS

The presence/absence of an ink in the embodiments to be described below represents not only a state wherein an ink is present and a state wherein an ink is absent, but also represents a state wherein an ink is present and a state wherein an ink has an amount insufficient for use.

An expression "on a substrate" on which light receiving elements, heat generating elements, function elements, and the like are arranged expresses not only a position on the substrate but also the interior near the surface of the substrate.

(First Embodiment)

Figure 1:
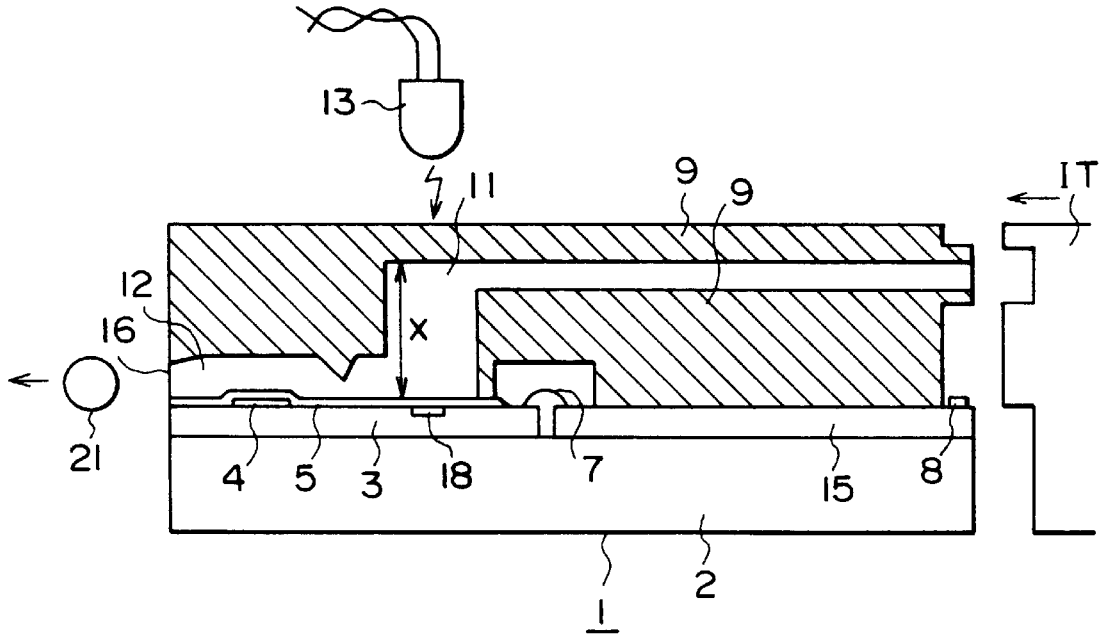
FIG. 1 is a sectional view for explaining an ink-jet head according to the present invention.
Figure 2:
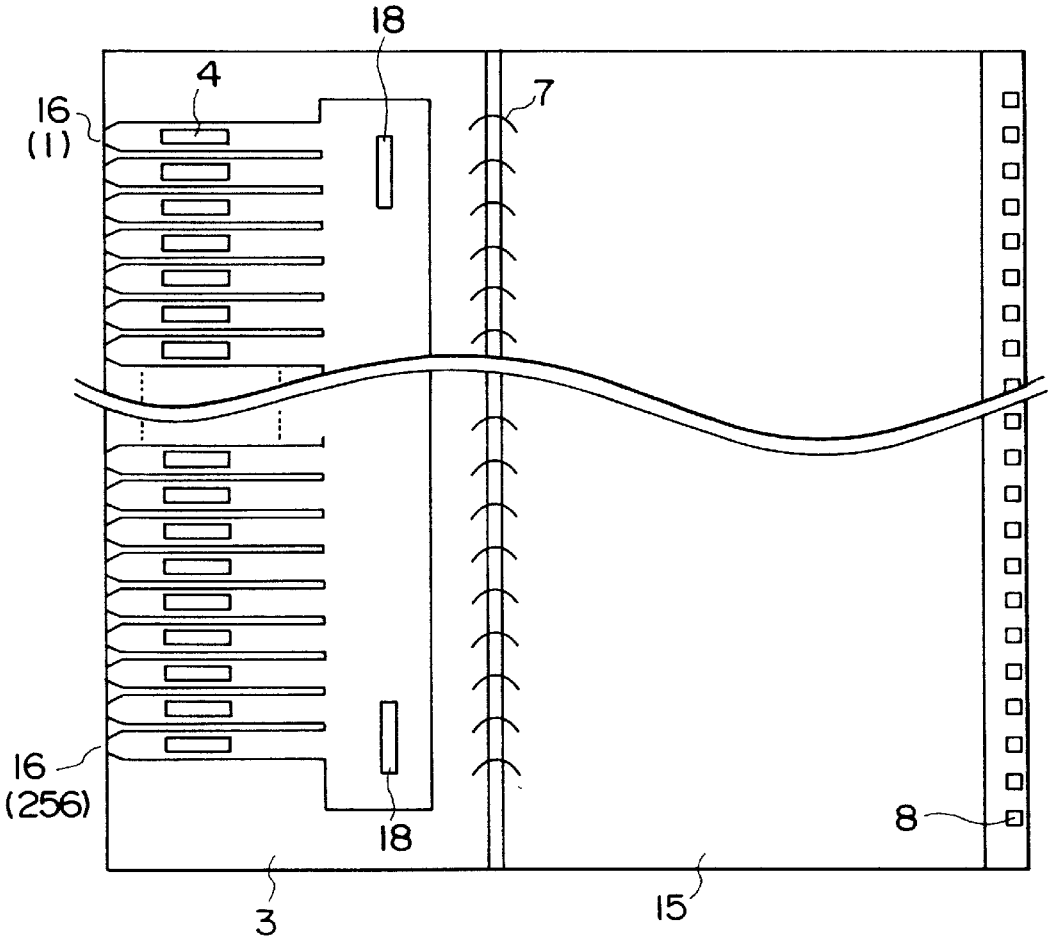
FIG. 2 is a plan view of the ink-jet head according to the present invention.

FIG. 1 is a sectional view of a recording head according to the first embodiment. FIG. 2 is a top view of a substrate 3 consisting of Si, and a PCB 15.

A recording head 1 is formed by fixing, by an adhesive, the substrate 3 and the printed circuit board (PCB) 15, which are constituted by silicon circuit boards and serve as an ink-jet control board portion including an electrical circuit, on an aluminum support member 2 mainly consisting of aluminum. The substrate 3 includes heat generating resistor elements 4 as discharge energy generating elements for discharging an ink by heating upon discharge of the ink, and a light receiving portion 18 as an optical element. The heat generating resistor elements 4 and the light receiving portion 18 are covered by a protection film 5 consisting of silicon oxide so as not to directly contact the ink. As described above, the light receiving portion 18 is arranged on a single chip together with an ink-jet control portion including the heat generating resistor elements 4. Thus, the manufacturing steps of the recording head do not require any special step of forming a light receiving portion, and the light receiving portion can be manufactured in the same manufacturing process as the conventional process, i.e., with almost no increase in cost. At least one light receiving portion need only be formed. In this embodiment, a total of two light receiving portions are arranged at two ends of a common ink chamber corresponding to a plurality of ink channels of the recording head. Also, two light emitting portions corresponding to these light receiving portions are arranged in advance in an apparatus which includes the recording head 1.

In a recording operation, an ink droplet is discharged from each discharge port 16. An ink to be discharged is supplied from an ink tank connected to the right side (FIG. 1) of the recording head to ink fine flow paths 12 which have pressure chambers and constitute ink flow paths, via an ink flow-in portion 10 and a common ink chamber 11 constituting the ink flow paths. A total of 256 discharge ports 16 and 256 ink fine flow paths 12 are arranged, and are arranged at a density of 360 dpi in a direction perpendicular to the plane of the drawing of FIG. 1. A height x of the common ink chamber 11 is about 3 mm.

A signal from a terminal 8 is supplied to the electrical circuit of the substrate 3 via wiring layers in the PCB 15 and bonding wires 7. The input signal is converted into ink discharge signals corresponding to a large number of discharge ports.

In FIG. 1, a structure above the substrate in the recording head corresponds to a top plate portion 9 which consists of a material having a high transparency with respect to light, and has a relatively thin portion as a light transmission portion, i.e., a region facing light sources and light receiving elements. This material preferably has a good anti-ink characteristic, and particularly adopts polysulfone in this embodiment.

Each LED 13 emits light when it is energized by a driving circuit (not shown), and light emitted therefrom is incident on the corresponding light receiving portion 18 as a photodiode having a light receiving area of about 1,200 $\mu m^2$ via the top plate portion 9 and an ink in the common ink chamber 11 of the recording head. The sensor generates a photocurrent Ish depending on the amount of incident light. A signal from each light receiving portion 18 is supplied to the recording apparatus via the bonding wires 7, the PCB 15, and the terminal 8, and is converted into a detection signal by a detecting circuit in the recording apparatus.

Light emitted from each LED as the light emitting portion is light in an infrared wavelength range having a peak wavelength of about 900 nm of output light. Also, each light receiving portion is an element having a peak wavelength of about 900 nm of a sensitivity characteristic. In this manner, when the light emitting portion and the light receiving portion have close wavelength characteristics, an ink can be most efficiently detected. As described above, since the wavelength range is set to fall outside the visible light range, the light emitted from the LED is not easily influenced by disturbance light due to external visible light, and as a result, high-precision discrimination information can be obtained.

However, when each light emitting portion 13 can generate a sufficiently high output, or each light receiving portion has a sufficiently high sensitivity, their wavelength characteristics need not coincide with each other. For example, the light emitting portion may comprise an incandescent lamp. This portion may be designed in correspondence with situations.

When the amount of light incident on the light receiving portion is small, an amplifying portion is preferably arranged near the light receiving portion, so that a detection signal from the recording head is not influenced by external electrical noise. In this case, the amplifying portion is arranged on the substrate together with the light receiving portion, thus achieving a compact structure of the head.

Figure 3:
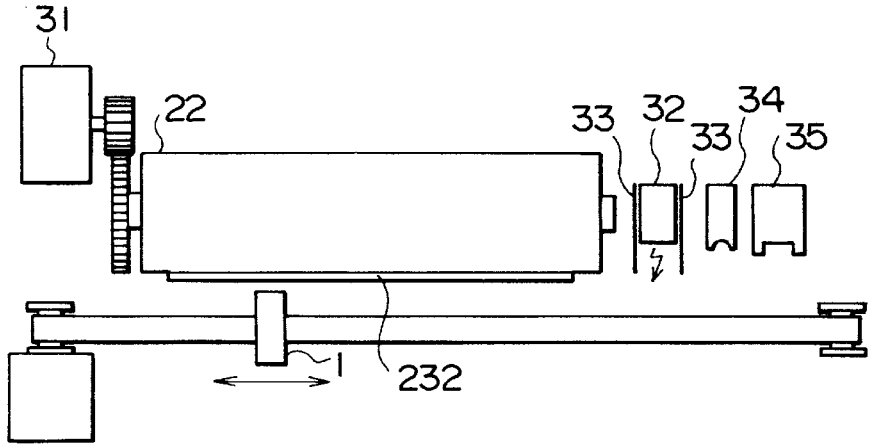
FIG. 3 is a schematic view showing the arrangement of a recording apparatus which comprises the ink-jet head according to the present invention.
Figure 4:
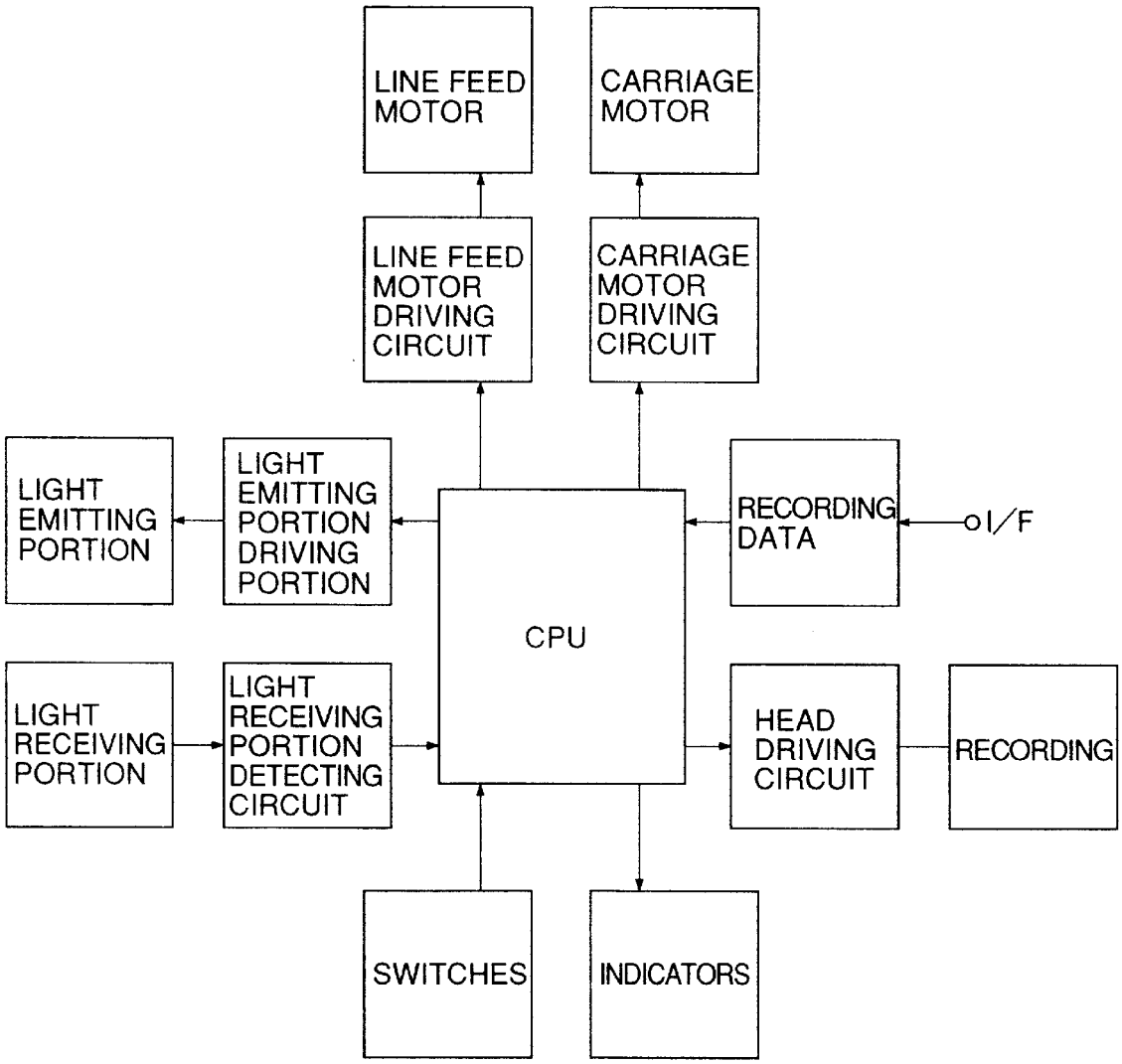
FIG. 4 is a block diagram of the recording apparatus which comprises the ink-jet head according to the present invention.

FIG. 3 is a schematic view showing the arrangement of a recording apparatus which comprises the recording head of the present invention. FIG. 4 is a driving block diagram of the recording apparatus which comprises the recording head of the present invention.

A CPU (central processing unit) comprises a ROM which stores programs of the recording apparatus, and a RAM for temporarily storing data.

A carriage motor moves the recording head in the main scanning direction (right-and-left direction in FIG. 3) via a carriage motor driving circuit.

A line feed motor 31 drives a platen 22 to move a recording medium 23 in the sub-scanning direction.

Recording data is externally inputted via an I/F as an interface portion. The recording data drives the recording head via a head driving circuit to discharge ink droplets at proper timings.

A capping means 35 moves to cap the distal end of the recording head when the recording head is located at the position of the capping means 35.

An ink receiver 34 causes the recording head to discharge an ink as needed and receives the discharged ink when the recording head passes near the ink receive 34.

Each light emitting portion 32 is driven by a light emitting portion driving circuit. Light incident on the corresponding light receiving portion is converted into an electrical signal by a light receiving portion detecting circuit, and the electrical signal is supplied to the CPU.

A light shield 33 shields disturbance light from being mixed in light emitted from each light emitting portion 32 and becoming incident on the light receiving portion.

An ink remaining amount detection sequence performed using the above-mentioned ink-jet head and the apparatus will be described below with reference to FIG. 5.

Normally, the recording head is located at the position of the capping means. When recording data is inputted (S51), the recording head moves in the direction of the recording medium (S52). During this movement, the recording head discharges an ink several ten to several hundred times in front of the ink receive (predischarge operation: S53). When the recording head has reached a position in front of the light emitting portions (S54), light is emitted from each light emitting portion toward the recording head (S55). At this time, the light incident on the corresponding light receiving portion of the recording head is detected by the light receiving portion detecting circuit (S56). If it is determined that the ink is absent in the common ink chamber, the recording head is returned to the capping position (S58), and an ink error is indicated using indicators (S59). On the other hand, if it is determined that the ink is present, a normal recording operation is executed.

Figure 5:
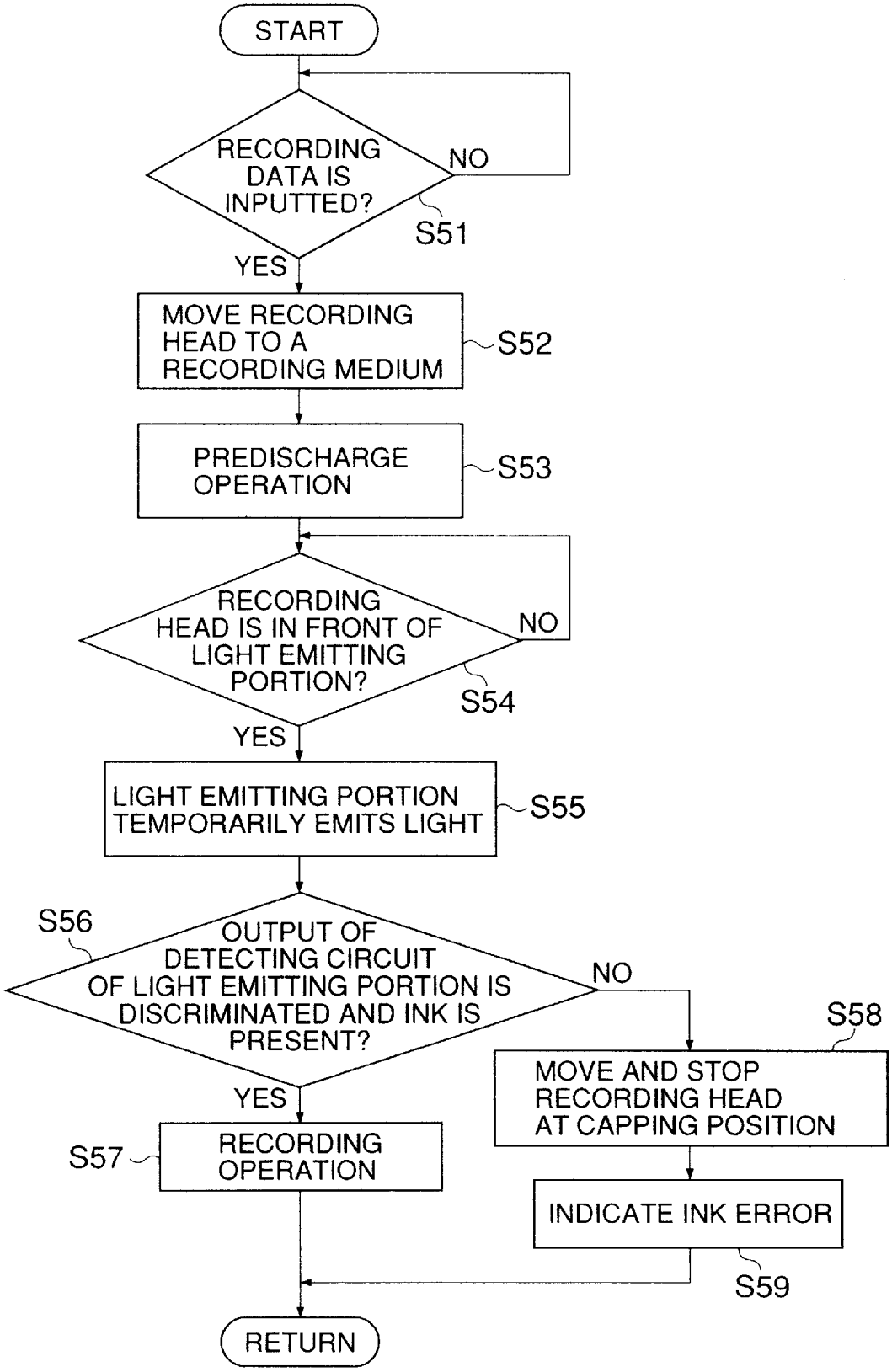
FIG. 5 is a flow chart of a remaining amount detection sequence.
Figure 6:
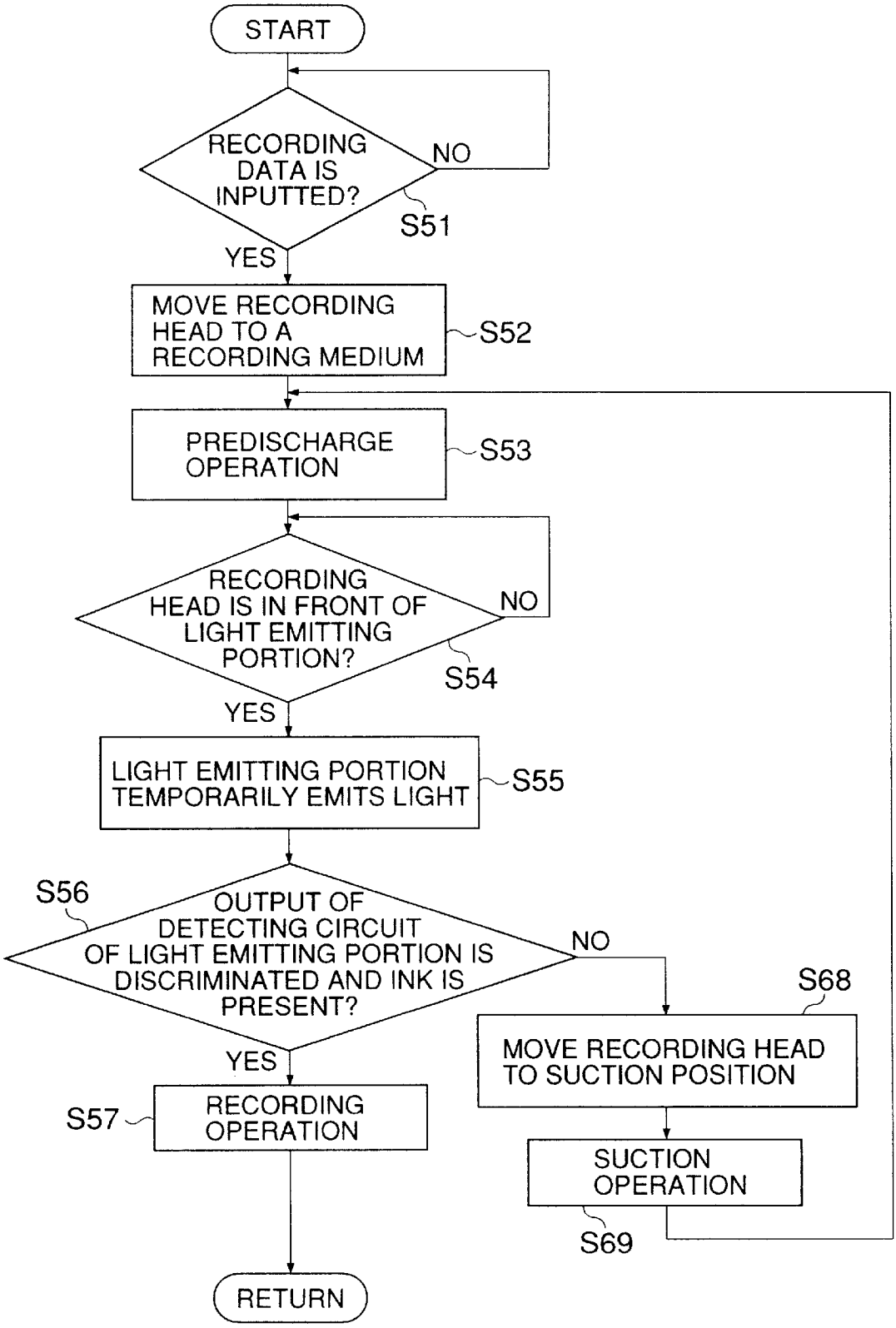
FIG. 6 is a flow chart of the remaining amount detection sequence.

In the sequence shown in FIG. 5, if it is determined that the ink is absent in the common ink chamber, an ink error is indicated. Alternatively, as shown in FIG. 6, a suction operation (S68, S69) may be executed.

In FIG. 5, the operation of the recording head is stopped after the capping operation when the absence of an ink is detected. Alternatively, a suction means may be arranged, and a normal recording operation may be started after the suction operation.

Figure 7:
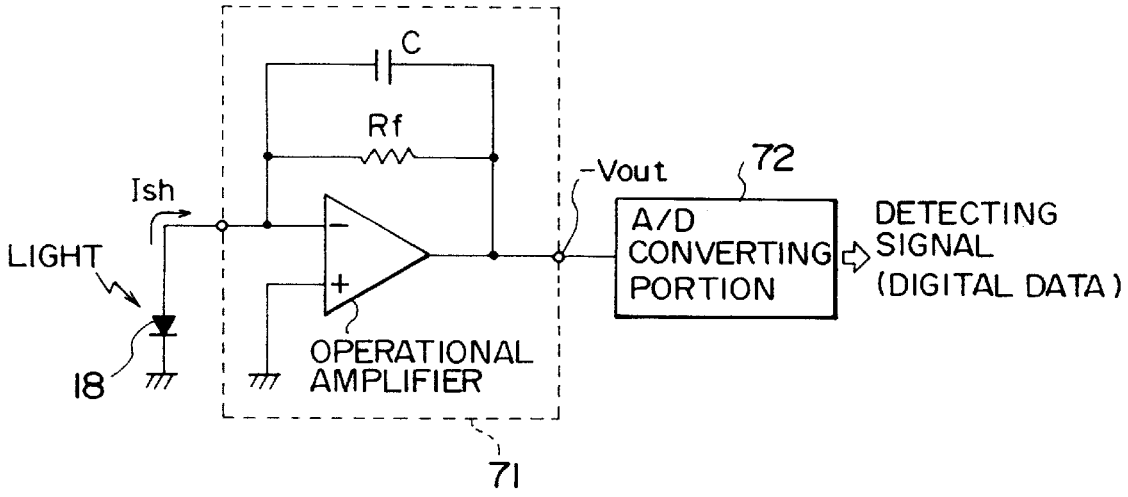
FIG. 7 is a circuit diagram showing a detection circuit.

FIG. 7 shows the light receiving portion detecting circuit. When light is incident on each sensor 18, a photocurrent Ish outputted from a photodiode as the sensor is converted into a voltage Ish×Rf=−Vout by a voltage converting portion 71 including an operational amplifier (where Vout is the absolute value of the output voltage). The output signal converted into the voltage is converted into a detection signal as a digital signal by an A/D converting portion 72, and the presence/absence of an ink in the common ink chamber in the recording head is discriminated. The A/D converting portion 72 normally comprises a comparator, and the presence/absence of an ink is discriminated by checking if Vout is a signal larger than a specific level Vth.

Figure 8:
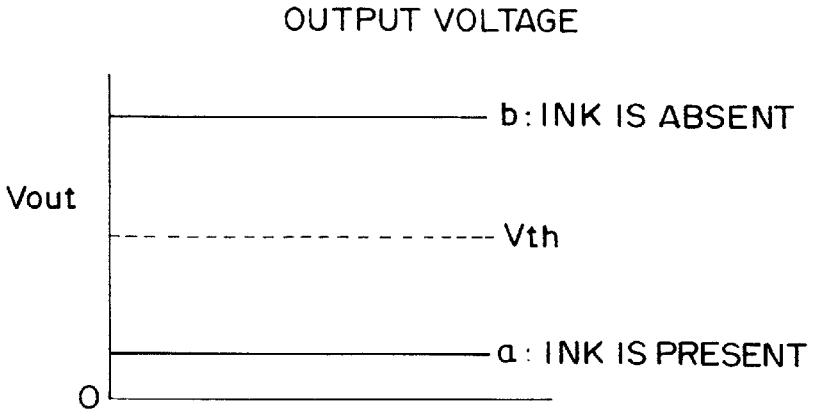
FIG. 8 is a graph showing an output voltage from the detection circuit.

FIG. 8 shows an example of Vout as an output from the voltage converting portion. A voltage a represents a case wherein the common ink chamber 11 of the recording head is full of an ink, and is almost close to 0. A voltage b represents a case wherein an ink is absent in the common ink chamber 11, and has a voltage value larger than Vth.

When the output signals from two sensors indicate the presence of an ink, the presence of an ink is determined. However, if at least one of the two sensor outputs indicates the absence of an ink, the absence of an ink is preferably determined.

In this manner, the presence/absence of an ink in the common ink chamber 11 of the recording head can be easily determined. If the absence of an ink is determined, the recording apparatus determines an out-of-ink state, and generates an alarm. Also, the recording apparatus executes processing operations for inhibiting the next recording operation, performing the recovery operation, and so on.

When the amount of ink is to be detected, the amount of ink present in the common ink chamber can be measured in accordance with a digital output value from the A/D converter.

Figure 9:
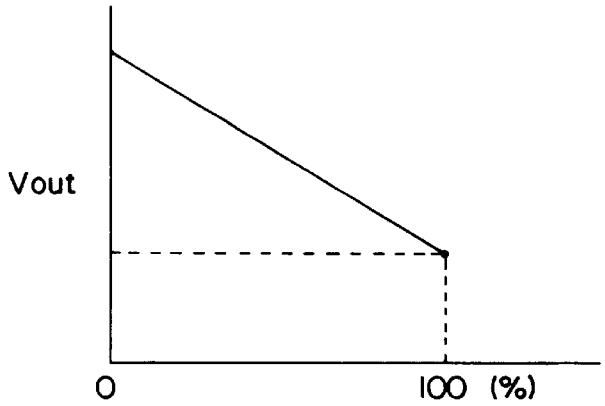
FIG. 9 is a graph showing an output from a sensor for measuring the amount of an ink.

FIG. 9 shows the relationship between the output voltage Vout from each sensor and the ink presence ratio (%) of a cyan ink in the common ink chamber.

By A/D-converting the voltage Vout, the voltage Vout can be measured, and the presence ratio of an ink can be detected. When a plurality of sensors are arranged like in the ink-jet head of this embodiment, an average value of the outputs from the two sensors is used as an average ink presence ratio.

Note that the out-of-ink state is determined in the following two cases: a case wherein an ink in the ink tank is used up, and no further ink can be supplied, and a case wherein although an ink is present, the ink cannot be supplied to the recording head due to some failure.

(Second Embodiment) Front Light Emission

In the first embodiment, light is emitted from the top plate side as a side portion of the recording head. However, the present invention is not limited to this arrangement. For example, light may be irradiated from the front surface side of the recording head, where the discharge ports are arranged.

Figure 10:
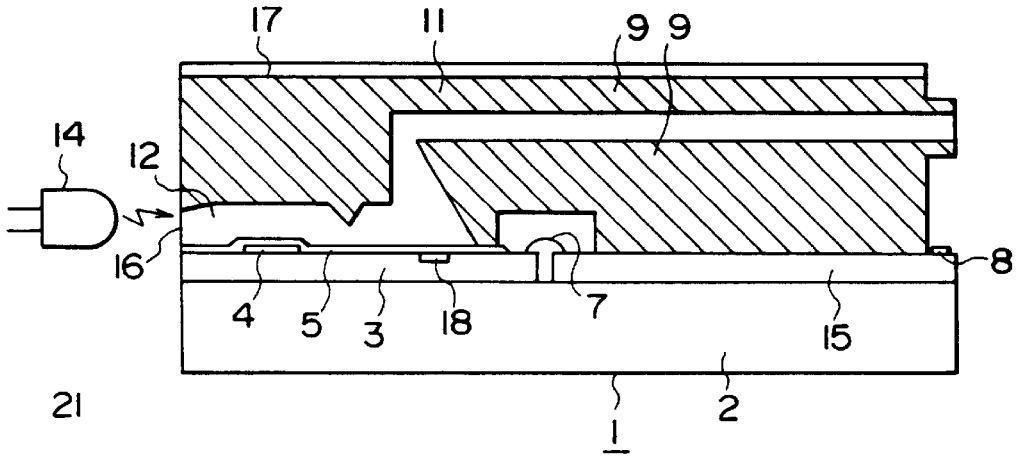
FIG. 10 is a sectional view showing an arrangement wherein light is irradiated from a discharge port surface.

FIG. 10 shows an arrangement used when light is irradiated from the discharge port surface, as the front surface, of the recording head. This arrangement is particularly effective when a plurality of recording heads are arranged adjacent to each other. Light reaches the sensor via the discharge ports, top plate, and the common ink chamber.

In FIG. 10, a white plate 17 reflects light irradiated from the LED toward the recording head, so that the light does not leak outside the recording head and efficiently becomes incident on the sensor 18. The white plate 17 is not limited to a plate in white color, but may consist of a material which can easily reflect light in a wavelength range where the sensitivity of the optical sensor is high. In particular, a member such as a mirror with high reflection efficiency is most preferable.

Irradiation of light and ink detection are performed in a non-recording operation state. For example, in a serial printer having main and sub scans, the above-mentioned operations are performed from when a recording operation for one main scan is completed until a recording operation for the next main scan is started.

In this case, the top plate portion preferably has a shape which allows light incident from the front sensor side to be easily focused on the sensor.

(Third Embodiment) On-chip Light Emitting Portion

In the first embodiment, the LED as the light emitting portion is arranged outside the recording head, i.e., the recording apparatus side, and the light receiving portion is arranged on the substrate of the recording head. However, the present invention is not limited to this embodiment, and only the light emitting portion may be arranged on the substrate of the recording head.

Figure 11:
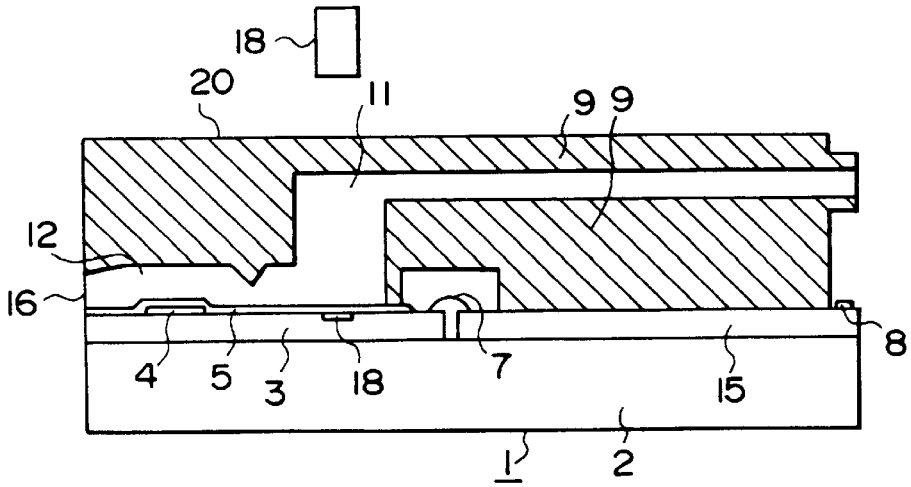
FIG. 11 is a sectional view showing an arrangement wherein a light emitting portion is arranged on an Si substrate.

FIG. 11 shows an arrangement in which the light emitting portion 13 is arranged on the substrate. The light emitting portion is arranged on the substrate, and light emitted from the light emitting portion is received by the light receiving portion 18 arranged outside the recording head via the common ink chamber 11 and the top plate portion.

In the first embodiment wherein the light receiving elements are arranged on the substrate, an amplifier must be arranged in the vicinity of the light receiving portions when the amount of light incident on the light receiving portion is expected to be small. In this case, the amplifier demands an extra area on the substrate of the recording head. An increase in area of the substrate directly leads to an increase in cost. In contrast to this, in this embodiment in which the light emitting portion is arranged on the substrate, the light emitting portion need only be arranged on the substrate, and does not increase cost. The output from the light receiving portion can be detected by a detecting circuit arranged outside the recording head, and an external detection circuit can use normal electrical circuit components, thus preventing an increase in cost.

(Fourth Embodiment) On-chip LED

In the first embodiment, the LED as the light emitting portion is arranged outside the recording head, and the light receiving portion is arranged in the recording head. However, the present invention is not limited to this arrangement, and the light emitting portion may also be arranged in the recording head.

Figure 12:
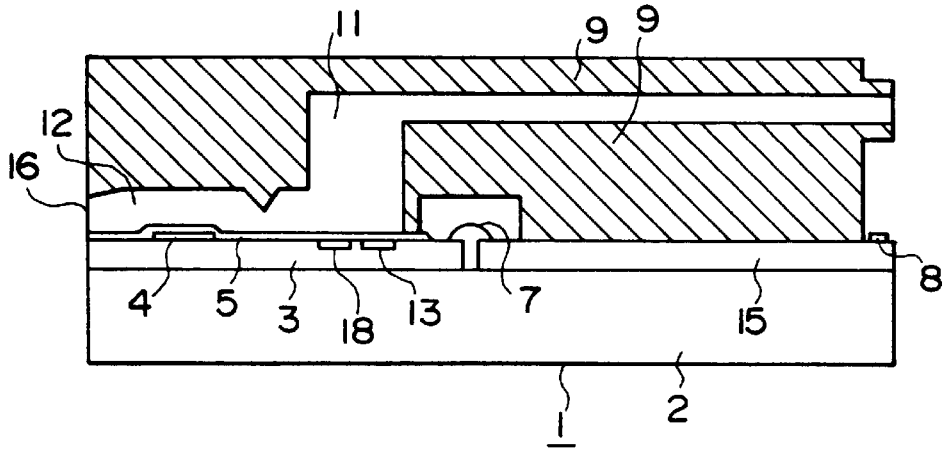
FIG. 12 is a sectional view showing an arrangement wherein a light emitting portion is arranged on a substrate.

FIG. 12 shows an arrangement in which both the light emitting portion 13 and the light receiving portion 18 are arranged on the substrate. Both the light emitting portion 13 and the light receiving portion 18 are arranged on the substrate. With this method, since light emitted from the light emitting portion is reflected by the top plate portion, and is incident on the light receiving portion, the top plate portion need not use a member having a high light transmittance. In addition, a variation in detection precision caused by nonuniformity of the thickness and material of the top plate portion can be eliminated, and the detection precision can be improved.

(Fifth Embodiment) Ink Chamber Separated Head

The first embodiment exemplifies the arrangement of a head which records one color ink by a single recording head. However, the present invention is not limited to this arrangement, but may be applied to the arrangement of a head which records four color inks by a single recording head.

Figure 13:
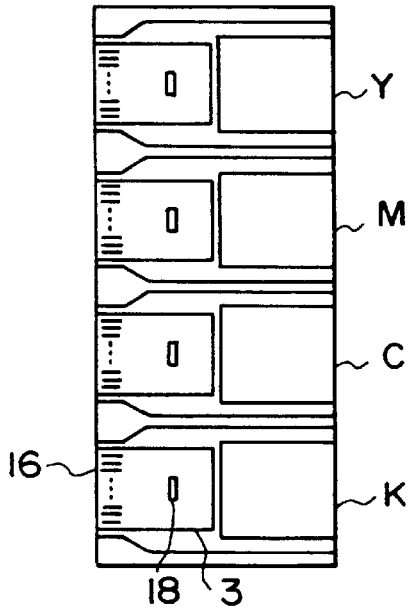
FIG. 13 is a plan view showing an example of a multicolor integrated head.

FIG. 13 is a top view of a recording head which can record four color inks by a single recording head and is provided with an ink sensor.

As inks, four color inks, i.e., Y: yellow, M: magenta, C: cyan, and K: black, are used. A total of four sensors corresponding to common ink chambers of the respective color inks are arranged. Only one LED as a light source is arranged at the distal end side of the discharge ports, as shown in FIG. 10.

(Sixth Embodiment) Density Detection

Furthermore, the density of an ink to be discharged is also detected to detect a failure such as deterioration of the ink due to aging, or an insertion error of an ink tank in a recording apparatus using an exchangeable ink tank.

For example, in a color recording apparatus which uses recording heads respectively using four color inks, i.e., Y: yellow, M: magenta, C: cyan, and K: black, if an ink tank of a given color is inserted in a wrong recording head, normal recording cannot be performed. When the densities of the inks are discriminated on the basis of signals detected by the sensors, an insertion error can be detected.

Figure 14:
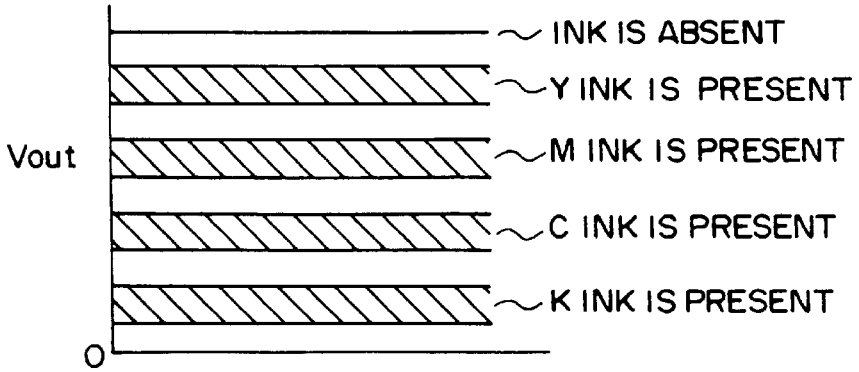
FIG. 14 is a graph showing Vout detection levels of four color inks.

FIG. 14 shows the level of a voltage Vout for discriminating the presence/absence of each color ink, and the ordinate represents the absolute value of the output level of the sensor. When the voltages fall within ranges corresponding to the colors, a normal state is determined; otherwise, an abnormal state is determined. This determination is achieved by comparing a voltage using the A/D converting portion as an A/D converter. The level of the K ink is closest to the zero level, and the level of the ink becomes higher in an order of C, M, and Y inks. Hatched portions represent level ranges where the corresponding inks are present. In practice, since there are a slight variation in ink density, a variation in machining precision of the top plate portion, and the like, such ranges are determined.

In general, since the light transmittance becomes higher in the order of Y, M, C, and K, the absolute value of the output level becomes larger in the order of K, C, M, and Y.

Note that output levels corresponding to the K, C, M, and Y inks may often overlap each other depending on the densities of dyes or pigments as coloring agents of inks used. In such a case, the heights of the common ink chambers and the thicknesses of the top plate portions are preferably optimized so as not prevent overlapping of the output levels depending on colors.

In detection of the ink density, an ink whose density becomes too high after preservation for a long period of time can be detected. When such a degraded ink is supplied to the recording head, it is detected, and the recording apparatus indicates an abnormal state.

Figure 15:
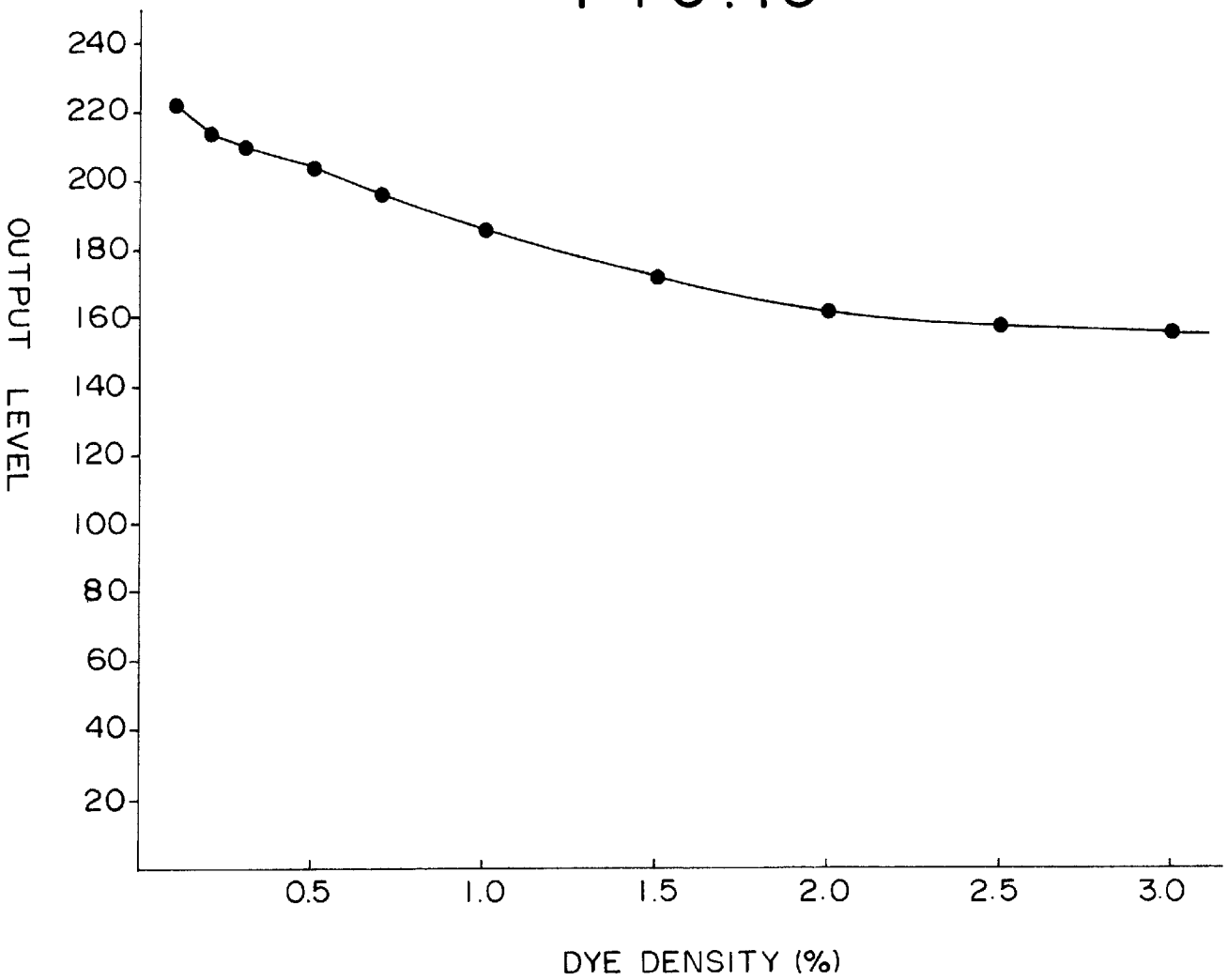
FIG. 15 is a graph showing an example of the output with respect to the dye density.

FIG. 15 shows an example of an A/D output corresponding to the dye density of the Y ink. In this case, the ink thickness as the height of the common ink chamber 11 is 3 mm. The output is an 8-bit signal, and indicates a maximum value of 255. The dye is direct yellow 86, and the major component of the Y ink is water. For example, if a dye density within a range of 2.5%±0.2% is normal, a normal dye density is determined when the output level falls within a range from 156 to 160.

(Seventh Embodiment) A Plurality of Sensors

Figure 16:
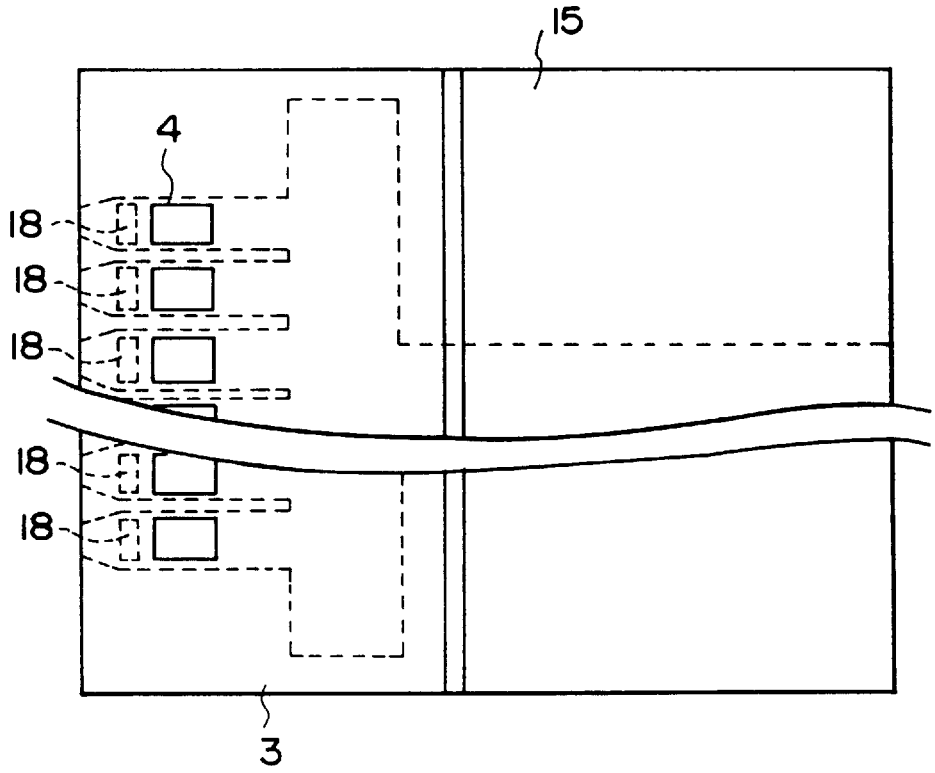
FIG. 16 is a plan view of a head according to the present invention.

In the first embodiment, two sensors are arranged in the recording head to detect an out-of-ink state in the common ink chamber or necessity of recovery from an abnormal state. However, the present invention is not limited to this arrangement. For example, two, three, or 256 sensors corresponding to discharge ports, as shown in FIG. 16, may be arranged. In particular, when sensors are arranged in correspondence with all the discharge ports, an out-of-ink state can be detected in units of discharge ports, and an error, e.g., a case wherein a specific discharge port is clogged with dust and cannot be supplied with an ink, can be detected. In this case, the heat generating elements are controlled (by increasing the application time of a driving pulse, increasing a voltage, or the like) to discharge ink droplets larger than a normal one from discharge ports at the two sides of the clogging discharge port, thus minimizing deterioration of recording quality.

(Eighth Embodiment) Sensor with Lens

In the first embodiment, light emitted from each LED as the light emitting element is incident on the corresponding sensor 18 via the flat-shaped top plate portion and the common ink chamber 11. However, the structure of the top plate is not limited to this. For example, the top plate may also have a structure of a lens. This arrangement can further improve optical discrimination precision.

Figure 17:
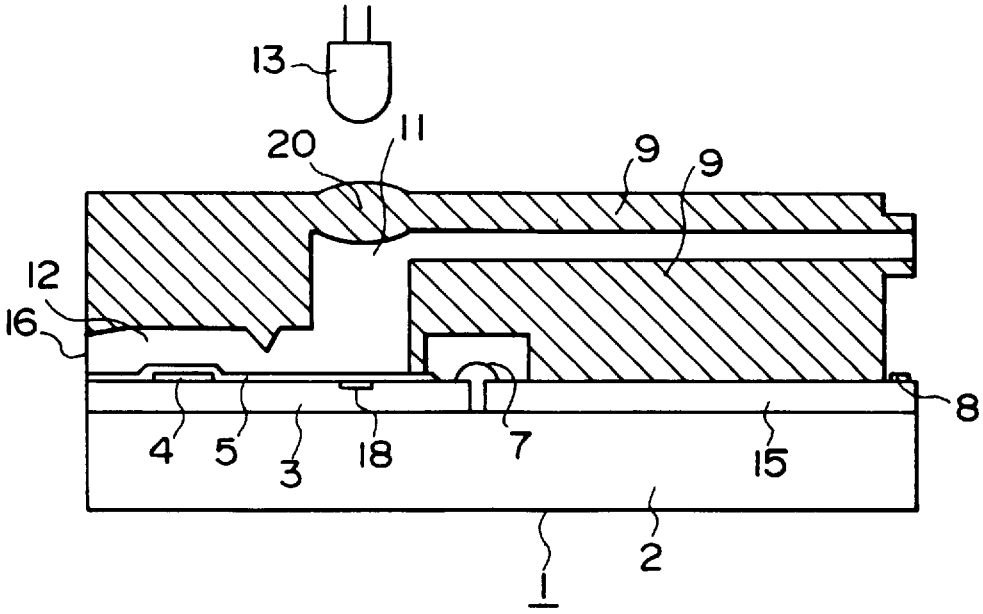
FIG. 17 is a sectional view of a recording head whose top plate portion has a lens structure.

FIG. 17 is a sectional view of a recording head in which a top plate portion has a lens structure. A lens 20 is a convex lens, and its focal length is determined so that light emitted from the LED is focused in the vicinity of the sensor. In place of the convex lens, a flat-shaped Fresnel lens may be used.

(Ninth Embodiment) Side Shooter Head

In the first embodiment, the recording head discharges an ink in a direction substantially parallel to the substrate surface on which the heat generating elements are arranged. However, the present invention is not limited to this arrangement.

Figure 18:
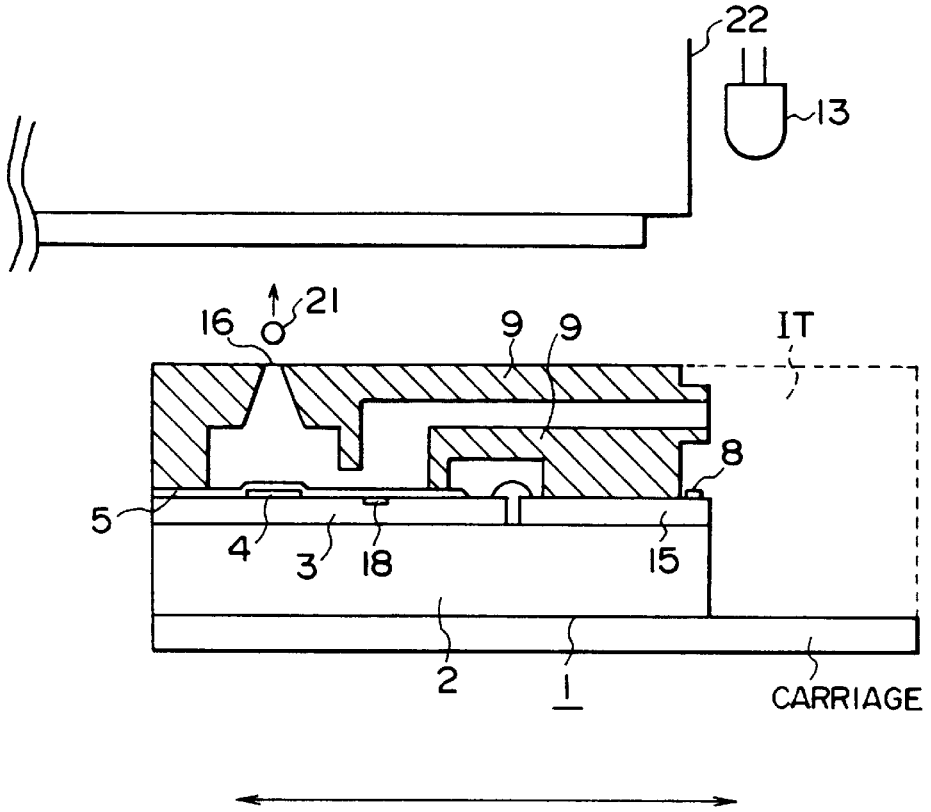
FIG. 18 is a sectional view showing a side shooter type head.

FIG. 18 shows an example of a recording head with an arrangement in which the ink discharge direction is substantially perpendicular to the substrate surface of the recording head. An ink droplet 21 is discharged upward in FIG. 18 from a discharge port 16. The discharged ink droplet 21 then becomes attached to the recording medium 23 supported by the platen 22, and is recorded thereon. The light emitting portion 13 is arranged beside the platen. The recording head 1 is supported by a carriage of the recording apparatus, and moves relative to the recording medium 23 to perform a recording operation.

One hundred and twenty-eight discharge ports 16 are aligned in a direction perpendicular to the plane of the drawing of FIG. 18.

(10th Embodiment) Sense of Paper Width, Sense of Home Position

In the embodiments described above, the presence/absence and density of an ink in the recording head are detected using the light emitting elements and the light receiving elements arranged on the substrate. In the embodiment to be described below, the arrangement and sequence for detecting the presence/absence of a recording medium and the home position of the recording head will be explained.

Figure 19:
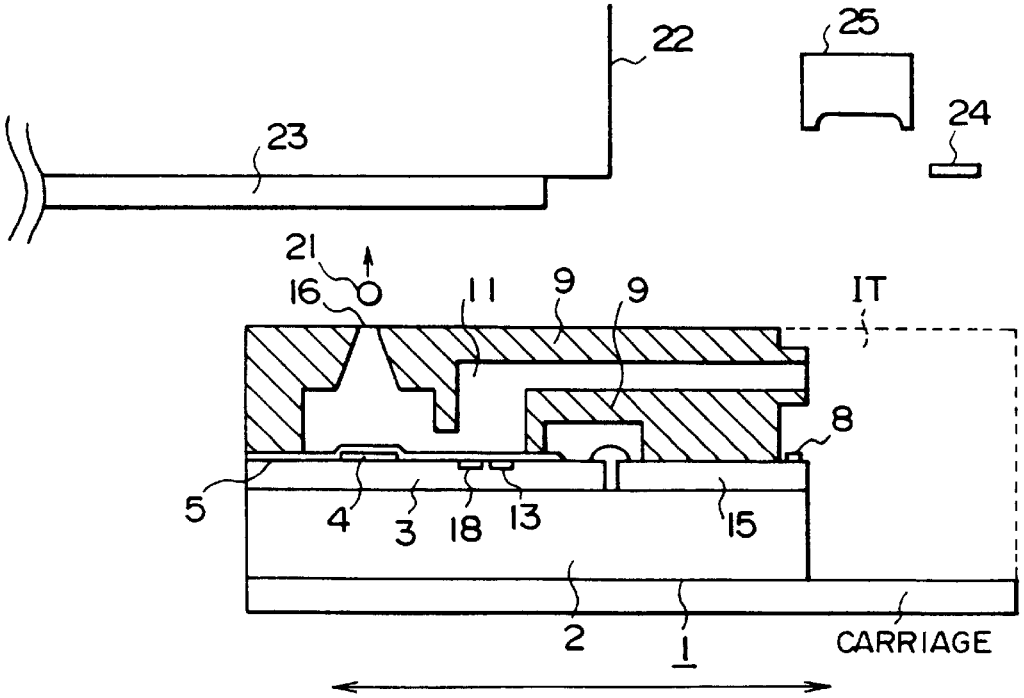
FIG. 19 is a sectional view showing an arrangement provided with a recording medium sensor and a home position sensor.

FIG. 19 shows an example of a recording apparatus which has the light emitting portion 13 and the light receiving portion 18 in the recording head, and detects the presence/absence of a recording medium and the home position of a carriage for moving the recording head. In the following description, detection functions of both the presence/absence of a recording medium and the home position will be exemplified. However, the apparatus may have either one of these functions.

A platen which constitutes the recording medium convey means of the recording apparatus has a material or shape, which does not easily reflect light, and is a black rubber member in this embodiment. On the other hand, the recording medium is white, so that it can more easily reflect light than the above-mentioned platen. Also, the home position marker is white, so that it can more easily reflect light than the above-mentioned platen.

Figure 20:
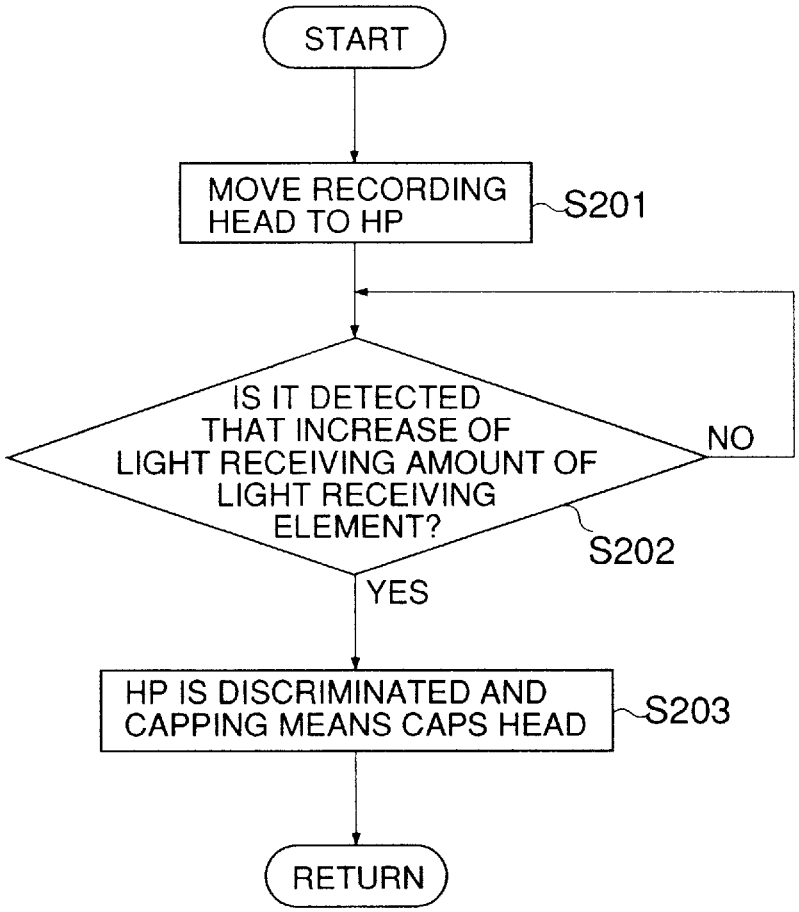
FIG. 20 is a flow chart showing a home position sensing sequence.

The home position sequence will be described below with reference to the flow chart in FIG. 20.

The recording head 1 moves in the right-and-left direction in FIG. 19 to perform recording. The recording head 1 moves toward a home position (HP) (right side in FIG. 19; S201). At this time, at a position A, light emitted from the light emitting portion is reflected by the top plate portion 9, and is detected by the light receiving element 18 via the common ink chamber 11. When the positions of the light emitting portion and the light receiving position move from the position A to a position B, since light reflected by a white home position marker 24 is also added at the position B, the amount of light received by the light receiving portion becomes larger than that at the position A. By discriminating the presence/absence of this increase in light amount (S202), the home position is detected. At the home position, when the recording operation is completed, a capping means 25 caps the discharge ports of the recording head (S203).

With this sequence, the home position of the recording head can be detected.

A sequence for detecting the presence/absence of a recording medium will be described below with reference to the flow chart of FIG. 21.

When the recording head is located in the home position (HP) region B, the light receiving element measures the light receiving amount, and stores the measured light amount as a light receiving amount B (S211).

Thereafter, the recording head moves toward a recording region (S212).

When a decrease in light receiving amount of the light receiving element is detected (S213), the decreased light receiving amount is stored as a light receiving amount A (S214).

Thereafter, a timer is started (S215). When the light receiving element detects an increase in light receiving amount within a predetermined time T1 (S216), the presence of a recording medium is discriminated (S217).

On the other hand, when the light receiving element does not detect an increase in light receiving amount within the predetermined time T1 (S216), the absence of a recording medium is discriminated (S218), and a home position sequence (S219) is executed.

A sequence for detecting the presence/absence and width of a recording medium will be described below with reference to the flow chart in FIG. 22.

Figure 21:
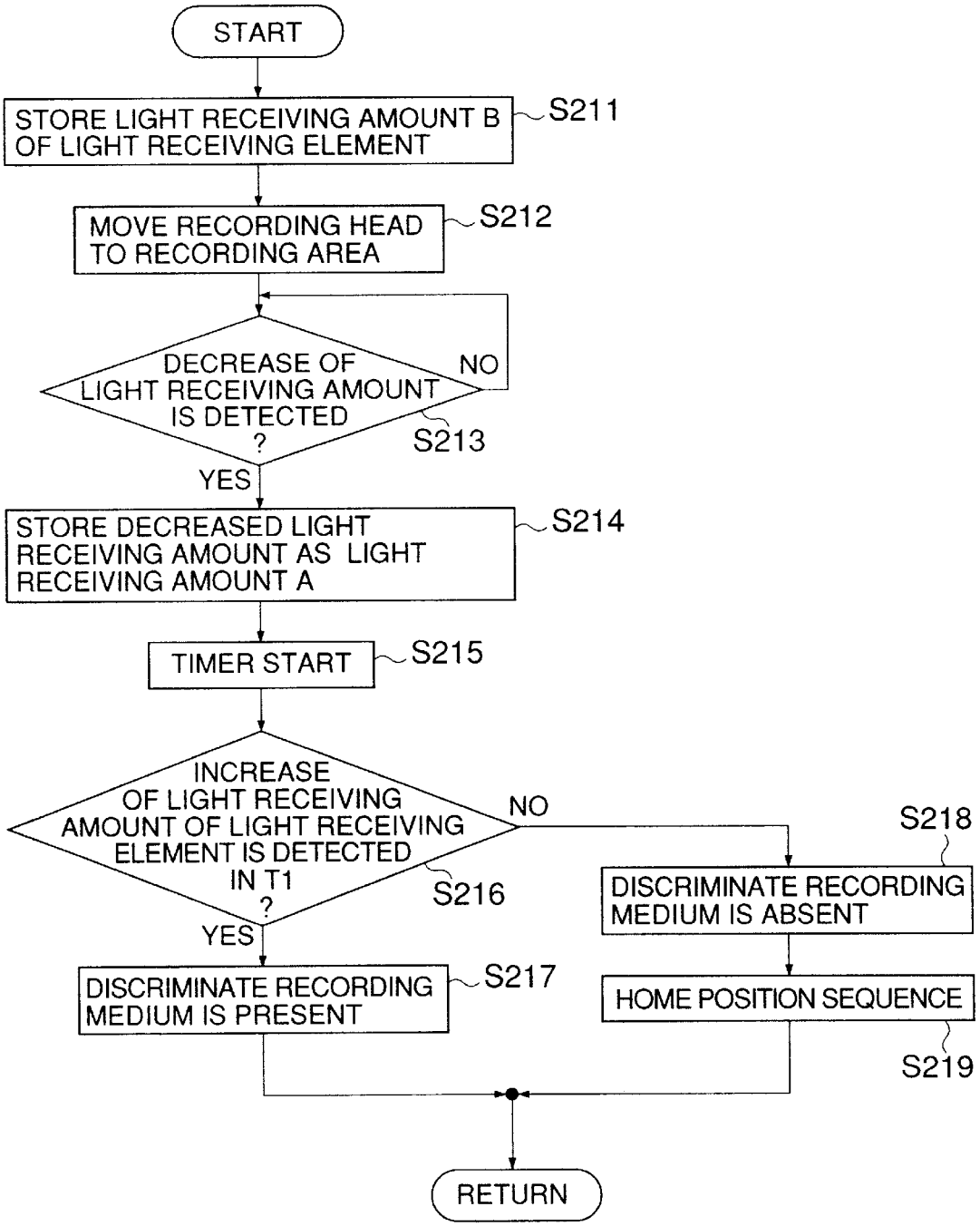
FIG. 21 is a flow chart showing a sequence for detecting the presence/absence of a recording medium.
Figure 22:
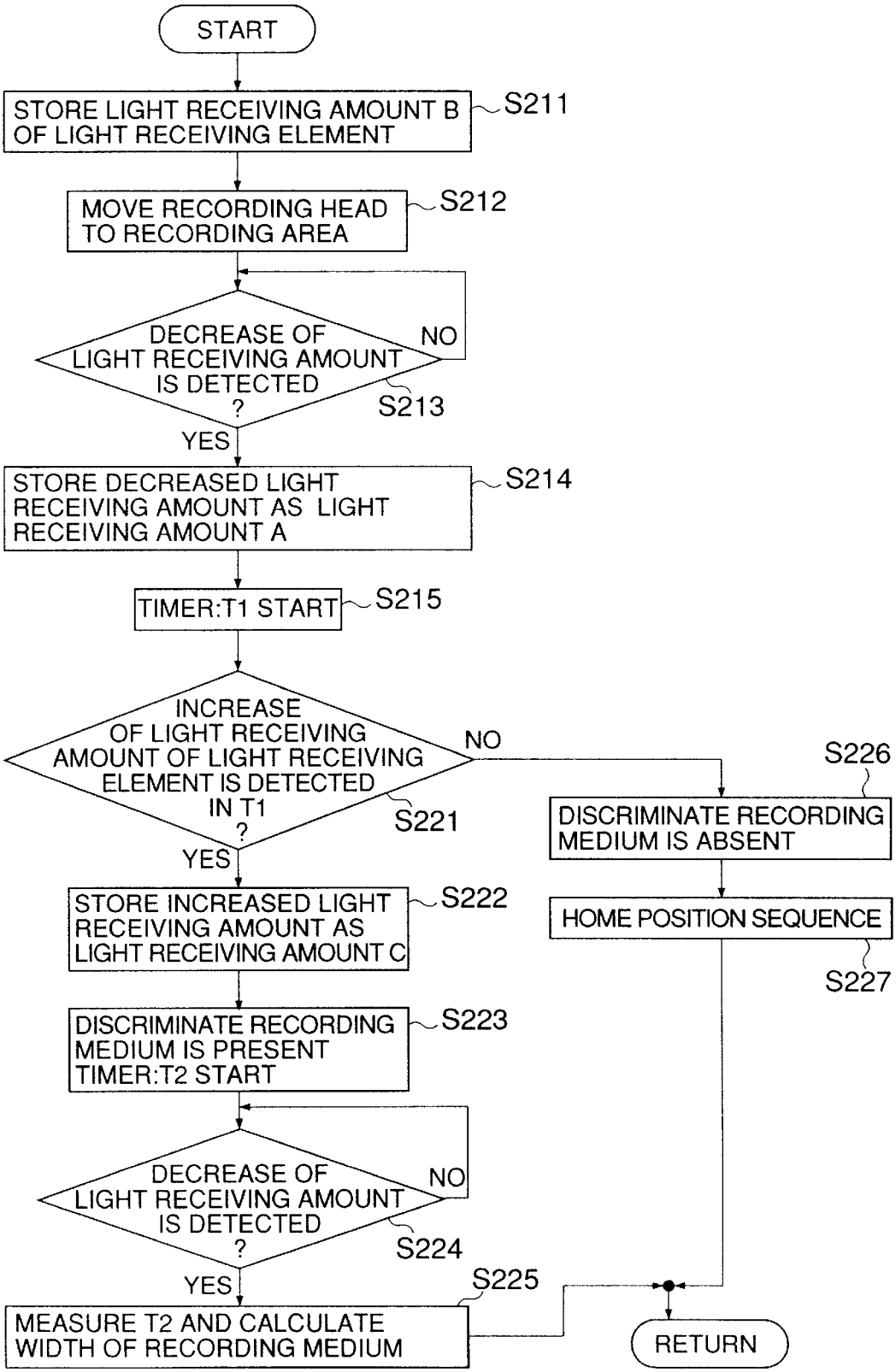
FIG. 22 is a flow chart showing a sequence for detecting the presence/absence and width of a recording medium.

Since the processing up to step S221 in FIG. 22 is the same as that up to step S216 in FIG. 21, a detailed description thereof will be omitted.

When the light receiving element detects an increase in light receiving amount within the predetermined time T1 in step S221, the increased light receiving amount is stored as a light receiving amount C (S222), and the presence of a recording medium is discriminated. At the same time, a timer for measuring a time T2 is started (S223).

When a decrease in light receiving amount is detected (S224), the time T2 at that time is measured, and the width of the recording medium is calculated based on the measured time T2 (S225).

On the other hand, when an increase in light receiving amount cannot be detected in step S221, the absence of a recording medium is discriminated (S226), and a home position sequence (S227) is executed.

With this sequence, the presence/absence and width of a recording medium can be detected.

(11th Embodiment) Also Measure Substrate Temperature

In the embodiments described above, the presence/absence and density of an ink in the recording head are detected. In this embodiment, the light receiving element comprises a photodiode, so that the temperature of the substrate can also be detected.

Figure 23:
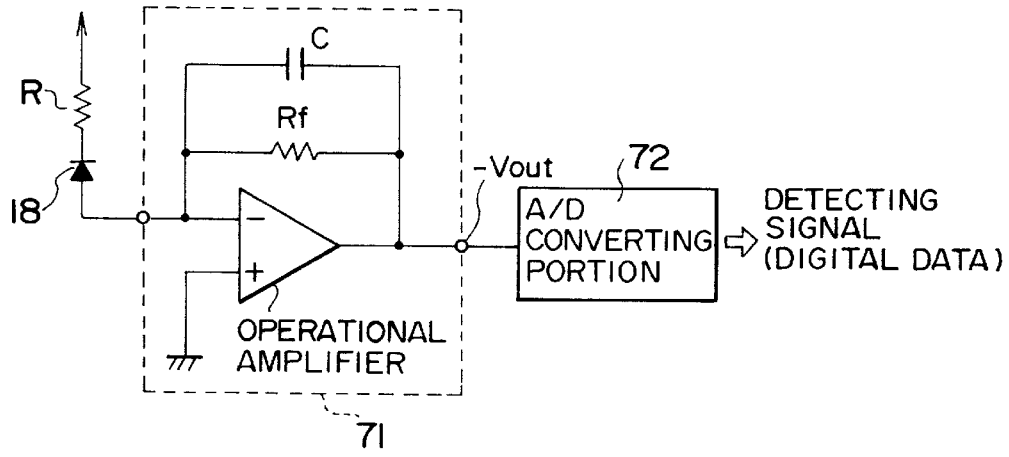
FIG. 23 is a circuit diagram showing a detection circuit.

FIG. 23 shows a detecting circuit portion when a single diode not only plays a role of an optical sensor but also performs temperature detection. The resistance of a feedback resistor Rf is selected to be an optimal value.

This diode element has a current-voltage characteristic, which changes depending on the temperature of the element. Also, this diode element provides a current-voltage characteristic depending on whether or not light is incident thereon. The two characteristics can be detected by utilizing these characteristics.

For example, in the arrangement shown in FIG. 1, the output obtained from the detecting circuit portion when the light emitting portion 13 is OFF, i.e., no light is incident on the light receiving portion corresponds to the temperature of the substrate. The temperature of the substrate can be detected from the relationship between this output and a predetermined temperature. Based on data of the detected temperature, the driving operation of the recording head may be controlled to prevent an increase in ink discharge amount at high temperatures, and the heat generating element or another temperature rise means is controlled to raise the temperature of the recording head so as to prevent a decrease in ink discharge amount at low temperatures.

The presence/absence and density of an ink are detected on the basis of the difference between an output obtained when the light emitting portion does not emit light, and an output obtained when the light emitting portion emits light.

An example wherein a photodiode is used as the light receiving element to detect the temperature of the head and the presence/absence (and the remaining amount and density) of an ink in the head will be described below.

Figure 24A:
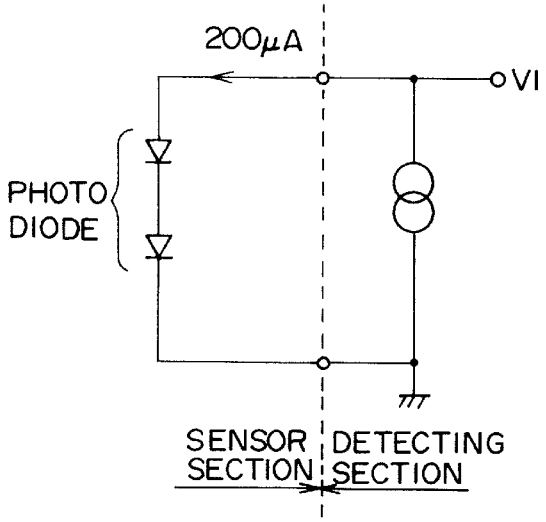
FIGS. 24A and 24B are circuit diagrams showing the circuit arrangements of a sensor portion and a detection portion.

FIG. 24A shows a circuit for detecting the head temperature using a photodiode.

Figure 24B:
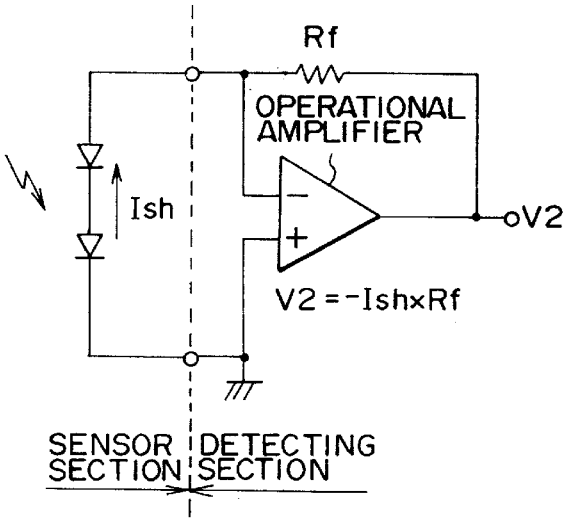

FIG. 24B shows a circuit for detecting the presence/absence of an ink using a photodiode. In addition, FIG. 25 shows a circuit arrangement for selectively performing detection operations of the head temperature and the presence/absence of an ink using a single photodiode.

Two photodiodes are connected in series with each other in the recording head. A head temperature detecting circuit supplies a constant current of about 200 $\mu$A to the photodiodes, and measures their terminal voltage V1. At this time, the light emitting element does not emit light. V1 is a temperature coefficient which is about 1.15 V at 25° C., and is about −4.3 mV/° C. By measuring V1, the temperature of the recording head can be detected.

On the other hand, an ink presence/absence detecting circuit measures the electromotive current of the photodiodes. A photocurrent Ish is generated in correspondence with the amount of light received by the photodiodes, and a voltage V2 is obtained by a feedback resistor Rf and an operational amplifier. As the light amount becomes larger, the absolute value of V2 becomes larger. More specifically, V2=−Rf×Ish. The presence/absence, remaining amount, and density of an ink can be detected based on the difference between V2 obtained when the light emitting portion is ON and V2 obtained when the light emitting portion is OFF. The resistance of the resistor Rf is selected in correspondence with the amount of light received by the photodiodes, so that the voltage V2 becomes an optimal voltage as an input to an A/D converter in the next stage.

Figure 25:
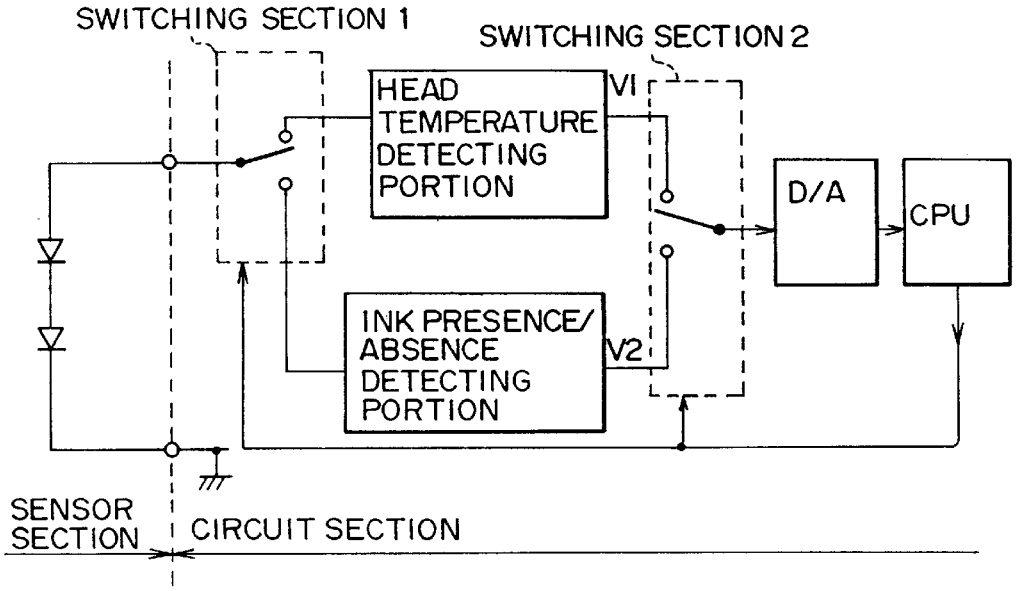
FIG. 25 is a circuit diagram showing the circuit arrangements of the sensor portion and the detection portion.

Switching sections 1 and 2 in FIG. 25 switch the connection of the photodiodes in the recording head to a head temperature detecting portion or an ink presence/absence detecting portion in a circuit section in the recording apparatus depending on whether the measurement mode of the photodiode is a head temperature detecting mode or an ink presence/absence detecting mode. Also, the switching sections supply a signal to an A/D converter in the next stage. A switching signal is supplied from a CPU.

The detected voltage signal V1 or V2 is supplied to and processed by the CPU via the A/D converter.

In this embodiment, the head temperature detecting section and the ink presence/absence detecting section are designed as independent circuits. This is because a current to be supplied to the photodiodes upon detection of the head temperature is 100 times or more a photocurrent generated upon detection of the presence/absence of an ink, and an output voltage indicating ink presence/absence detection cannot be detected by a detecting circuit upon detection of the head temperature.

However, by improving the sensors or detecting circuits, these two circuits may be combined. For example, the precision of the A/D converter in the next stage may be improved. In this manner, head temperature detection and ink presence/absence detection may be performed by a single circuit.

(12th Embodiment) Adjustment of Registration Among Colors

In the embodiments described above, the presence/absence and density of an ink in the recording head are detected. In a multi-head recording apparatus having a plurality of recording heads, landing positions among colors can be corrected.

Figure 26:
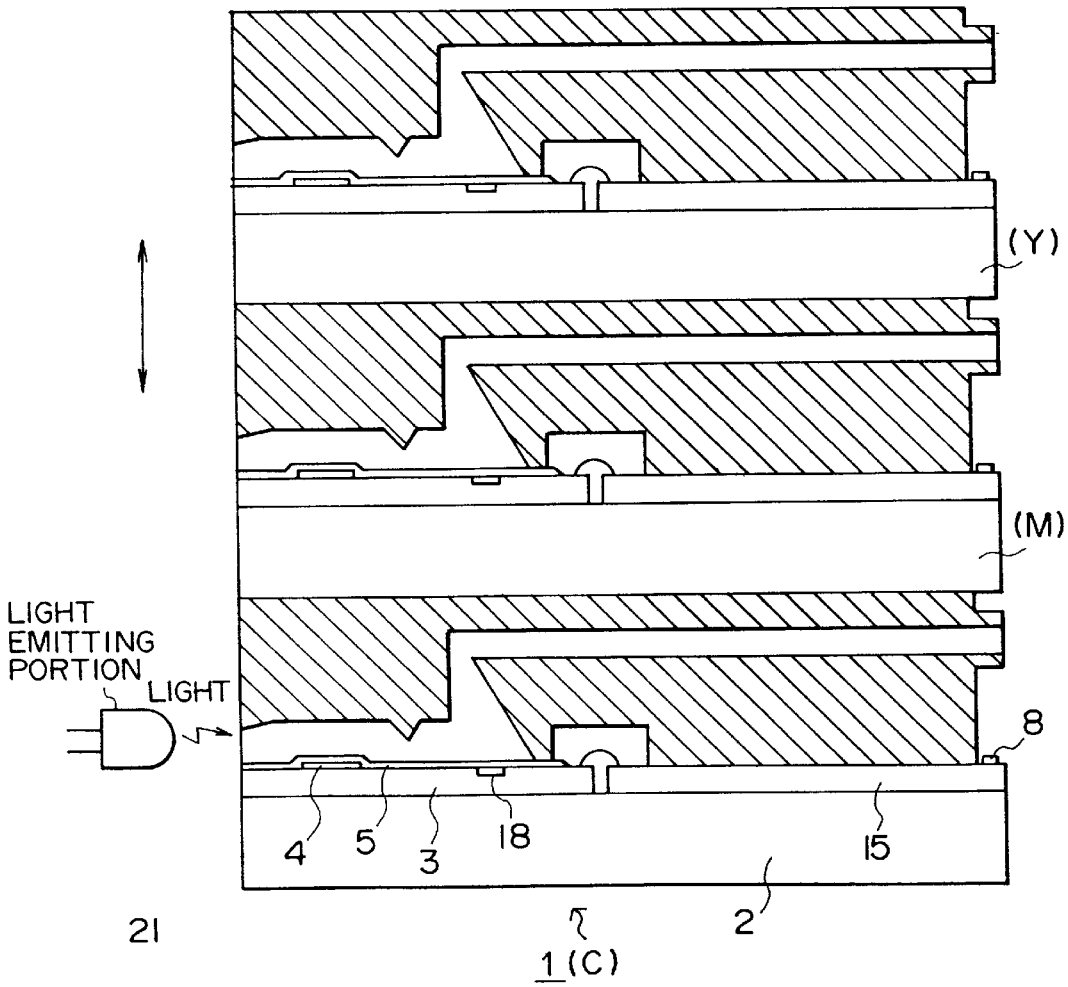
FIG. 26 is a sectional view showing the arrangement of a multi-head.

FIG. 26 shows an example wherein three recording heads are used. The recording heads are prepared to respectively record Y, M, and C colors. If the mechanical positional adjustment of the three heads is perfect, no problem is posed. However, a mechanism for always maintaining the perfect positional adjustment is expensive. For this reason, the heads suffer a position shift, and as a result, a registration error is generated in recorded characters or images.

A carriage which is integrated with a recording head unit including three heads is moved relative to the light emitting portion, and a position detection operation for detecting a relative positional difference of the heads is performed on the basis of a change in light receiving amount of the light receiving portion for each color at that time. Based on this information, the ink discharge timing is corrected in a recording operation, and as a result, recording with correct landing positions, i.e., free from a registration error can be attained.

More specifically, the carriage is moved at a predetermined speed in the main scanning direction in, e.g., a recording method including main and sub scans, and the position detection operation of the recording heads is performed.

Figure 27:
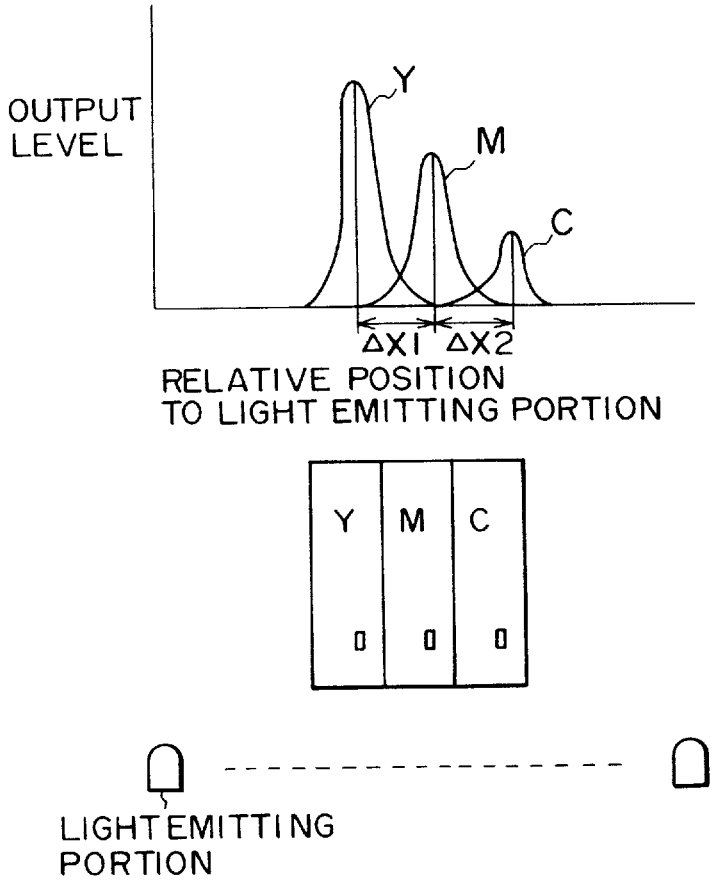
FIG. 27 is a graph showing the output levels at the relative positions of light emitting portions of a plurality of heads.

FIG. 27 shows the levels of output signals from the light receiving portions of the heads with respect to the carriage position in the position detection operation. The peak position of the output level of a relative position between the light emitting portion and each color recording head is detected by detecting the output level while moving the carriage in the main scanning direction. The detected relative position is stored in a storage section in the recording apparatus, and in a recording operation, the ink discharge timing from each color recording head is corrected based on the stored data.

Figure 28:
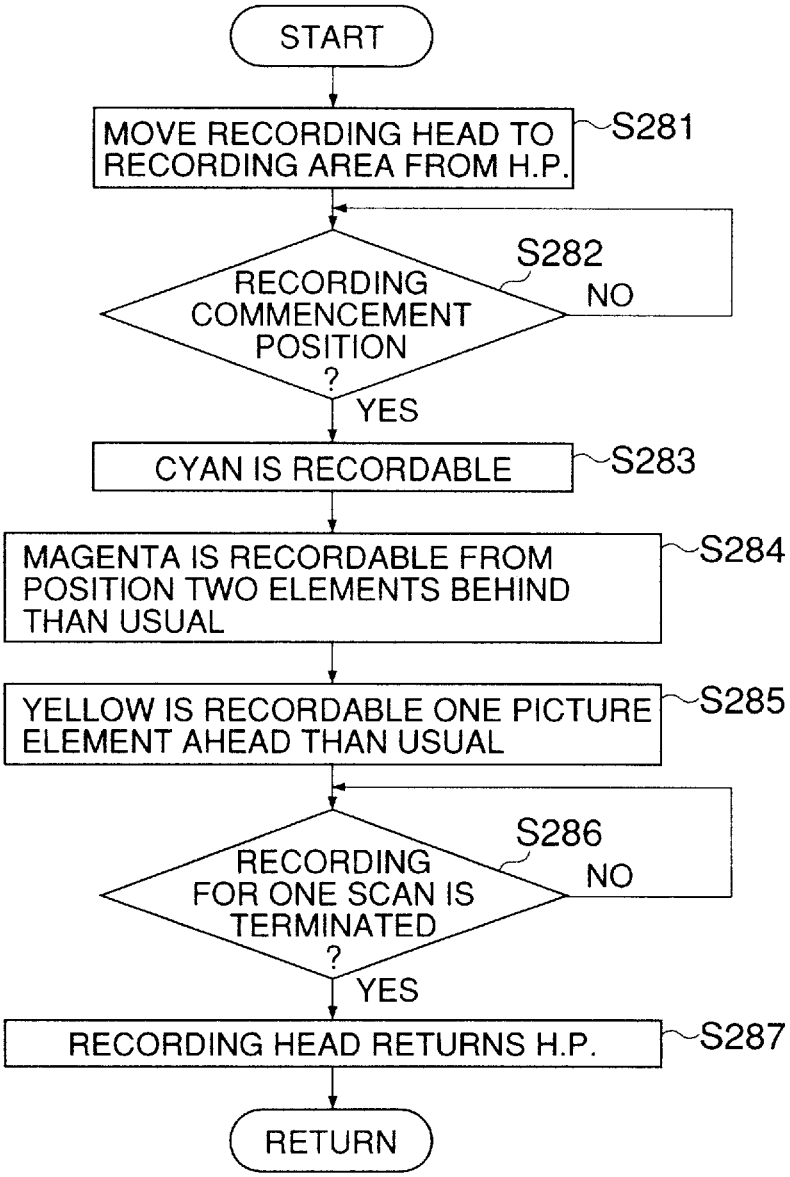
FIG. 28 is a flow chart showing a sequence for detecting and adjusting a position shift.

A flow in one scan for performing recording while adjusting a position shift among the heads will be described below with reference to FIG. 28. Note that this flow is based on the heads shown in FIG. 26 and detected data shown in FIG. 27.

Ideally, a pitch pichH between two adjacent heads is 180 pixels, and ΔX1 and ΔX2 in FIG. 27 are respectively given by:

$$\Delta X1=\text{pichH}$$

$$\Delta X2=\text{pichH}$$

One pixel is 70.56 $\mu m^2$.

Assume that measurement results ΔX1=pichH−1 (pixels) and ΔX2=pichH+2 (pixels) are obtained.

The recording heads are arranged in the order of C, M, and Y from the recording operation region side toward the home position side. The standard color is assumed to be C.

In step S281, the recording head is moved from the home position (HP) side toward the recording region (RP) side. If C data is detected at the recording start position (S282), the cyan (C) recording head is sequentially set to be recordable (step S283). Then, the magenta (M) recording head is set to be recordable from a position delayed by two pixels from a normal position (S284). Thereafter, the yellow (Y) recording head is set to be recordable from a position advanced by one pixel from a normal position (S285). When a recording operation for one scan is terminated (S286), the recording head returns to the HP side (S287). Based on this data, the ink discharge timings of the color recording heads are corrected.

(13th Embodiment) Full-line Head

In the embodiments described above, the presence/absence and density of an ink in the recording head are detected. Also, in the multi-head recording apparatus having a plurality of recording heads, the landing positions among colors can be corrected.

Furthermore, registration correction of a full-line head using different colors can be realized.

Figure 29:
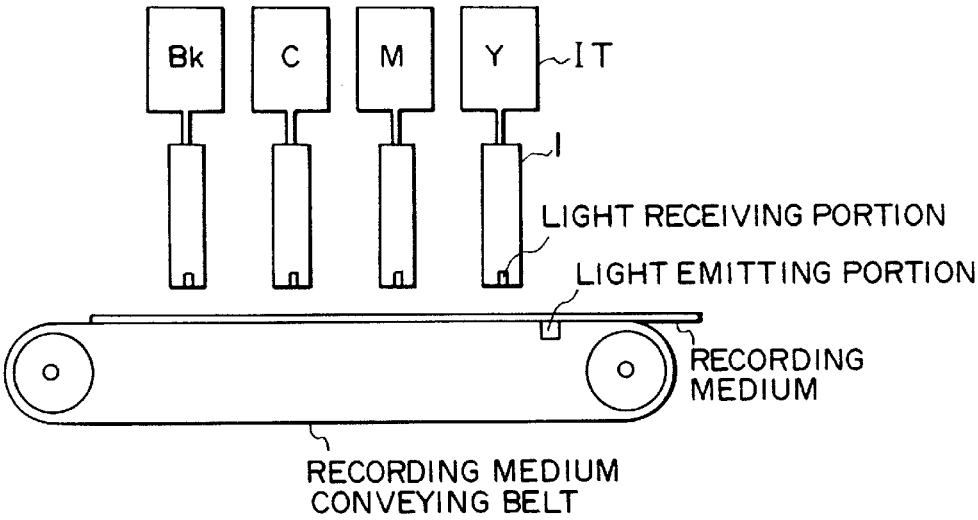
FIG. 29 is a view showing a case wherein a large number of full-line recording heads are used.

FIG. 29 shows an example of a full-line recording apparatus, which uses four recording heads each having 3,000 discharge ports that are linearly arranged at a density of 300 dpi, and which performs A4-size recording by conveying only a recording medium.

A recording medium is conveyed by a recording medium conveying belt. This belt has a light emitting portion on a portion, and the light emitting portion moves together with the belt. During a recording operation, the recording medium is conveyed by the belt.

A head position detecting operation detects the positional relationship among the recording heads. In this operation, the recording medium is not conveyed. Only the light emitting portion moves below the recording heads at a predetermined speed. When the light emitting portion has reached a position below each recording head, light becomes incident on the corresponding light receiving portion, and a position where the light receiving amount has a maximum value corresponds to the position of the recording head. In this manner, the positions of Y, M, C, and Bk color recording heads are accurately measured to store position information in a memory.

In a recording operation, the driving timings of the color heads are adjusted on the basis of the position information. More specifically, registration correction is performed. With this operation, even when the recording heads suffer a slight position shift, recording can be normally achieved.

Furthermore, each head has two light receiving elements at its two ends, and two light emitting portions are arranged at corresponding belt positions. Based on detection signals from these light receiving elements, the tilt angle of the recording head with respect to the recording medium conveying direction is detected, and the recording head is driven at a corrected driving timing in a recording operation. Thus, even when each recording head suffers a slight tilt, recording can always be normally achieved.

Figure 30:
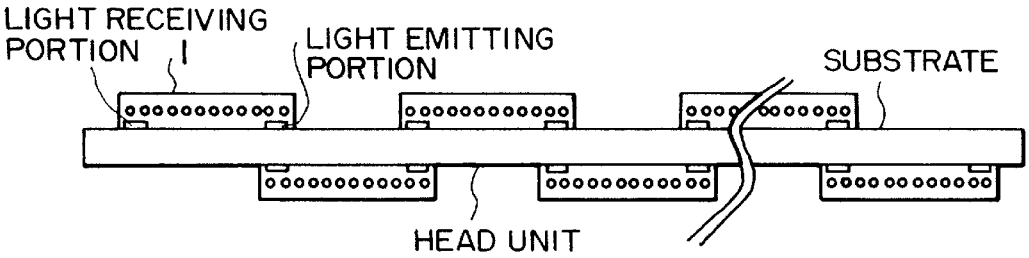
FIG. 30 is a view showing the zigzag arrangement of the full-line recording heads.

FIG. 30 shows another example, in which a single head unit is constituted by a plurality of recording heads. Each recording head has 12 discharge ports and two light receiving portions. The recording heads are fixed to a substrate. A single head unit is constituted by 300 heads. The number of effective discharge ports of each recording head is 10, and the two remaining discharge ports are used when the recording position is shifted. The fixing position precision of each recording head to the substrate is detected by the light receiving portions of the recording head. The detecting operation is the same as that in FIG. 29. For example, when a specific recording head is shifted to the left by one discharge port, the discharge ports to be used are selected to correct this shift.

(14th Embodiment)

In recent years, an apparatus which allows exchange of different types of heads and performs recording using the different types of heads, and an apparatus which improves image quality or achieves multi-value data using heads having different inks have been proposed and commercially available.

Upon discrimination of attachment of one of heads having different characteristics to an apparatus or upon discrimination of the ink remaining amount of the attached head, the light emitting elements and light receiving elements are set to have different characteristics in correspondence with the heads having different characteristics, and a discrimination criterion is provided to the apparatus, thus easily achieving such discrimination.

Figure 31:
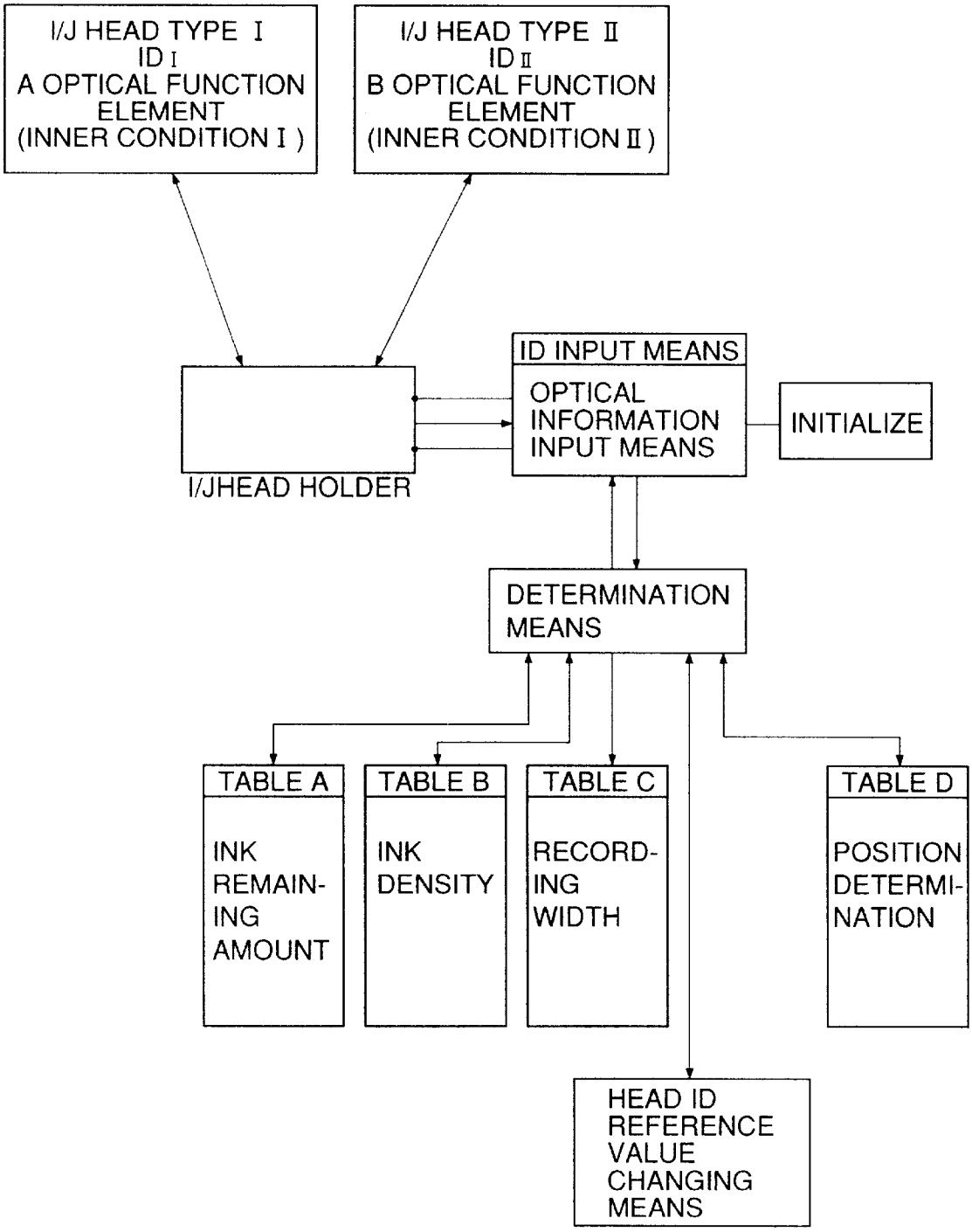
FIG. 31 is a block diagram showing discrimination blocks in an apparatus using an exchangeable head.

The block arrangement of such an apparatus will be described below with reference to FIG. 31.

One of heads having different conditions (type I and type II) is exchangeably mounted on an ink-jet (I/J) holder of the apparatus.

Each head has a memory which stores a condition such as the number of discharge ports, the driving voltage, and the like in addition to an optical function element.

When one of these heads is mounted on the I/J holder, the above-mentioned condition is read by an optical information input means which also serves as an ID input means, and the discrimination criterion of the read condition by an optical sensor is set by a discrimination means.

(15th Embodiment)

Figure 32:
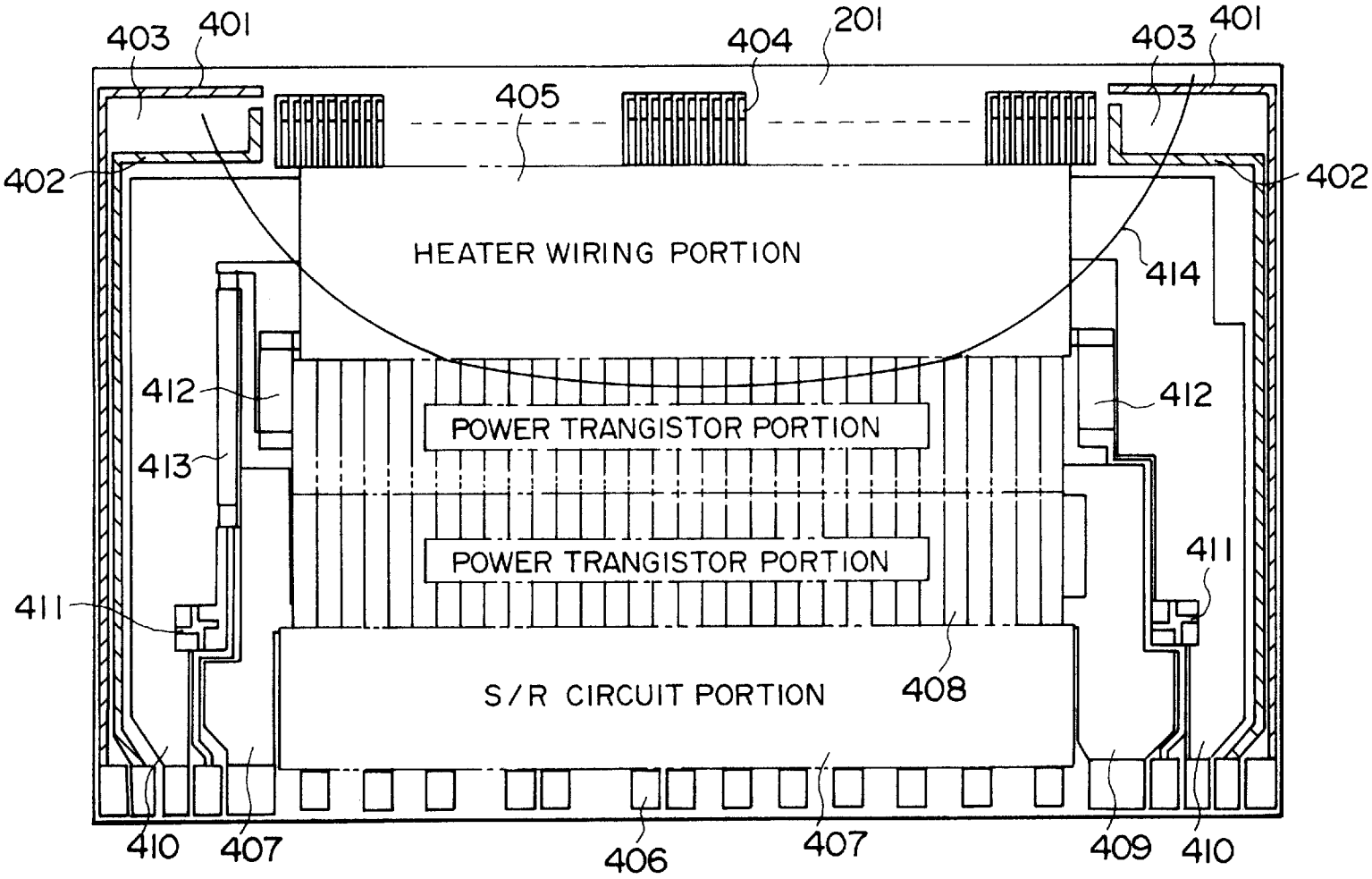
FIG. 32 is a view showing a sensor layout.

In the above-mentioned embodiments, as shown in FIG. 32, two photosensors as the light receiving elements are arranged at two sides of the heat generating elements. In order to obtain higher sensitivity, the areas of the substrate occupied by the photosensors must be increased accordingly, as described above, resulting in an increase in cost of the head. FIG. 32 illustrates sensor anode electrodes 401, cathode electrodes 402, detector portions 403 of the sensors, heat generating elements 404, a wiring portion 405 for connecting the heat generating elements to a VH wiring layer 410 and driving transistors 408, contact pads 406 with an external circuit, a logic circuit portion 407 corresponding to the logic portions 103 and 104, transistors 408, a GND wiring layer 409, the VH wiring layer 410, an assembling position alignment mark 411, a sub heater 412 for temperature control, and a rank heater 413 for setting power to be applied to the heat generating elements. Furthermore, in the sensor layout shown in FIG. 32, the sensors do not sense all the bubbles in the common ink chamber since they are arranged at the two ends of the heat generating elements. Note that a curve 414 indicates a range where an ink is present on the substrate, i.e., a boundary between a position below discharge ports 301 and an ink chamber 305, and an external portion.

Figure 33:
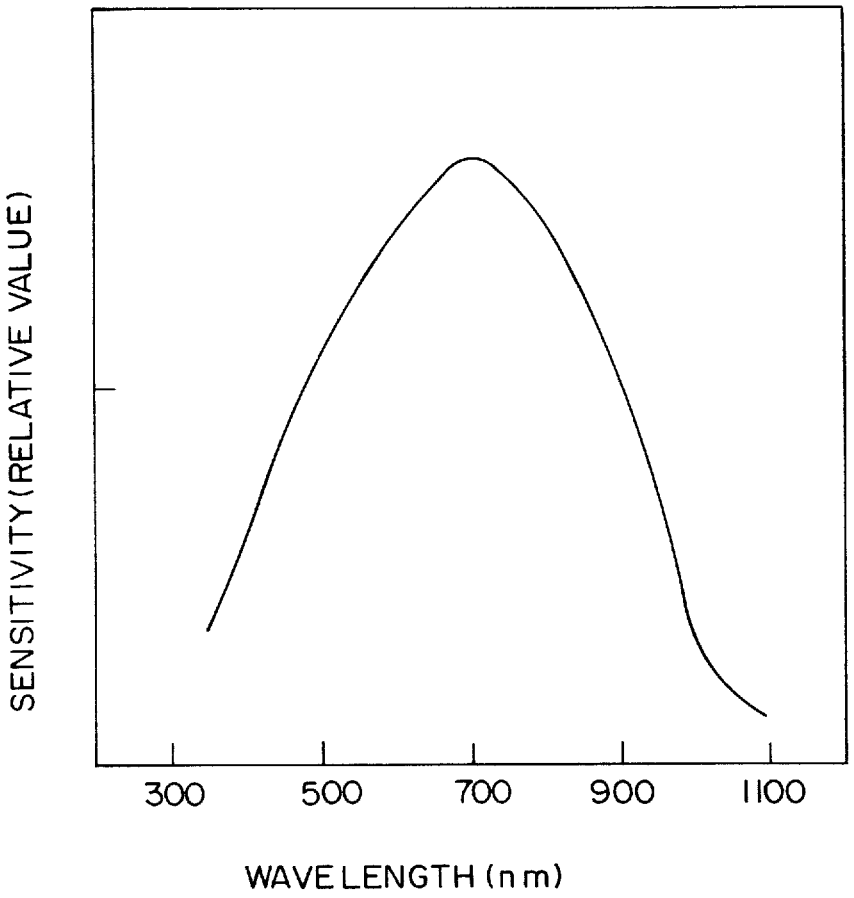
FIG. 33 is a graph showing the wavelength dependence of the sensitivity of a silicon semiconductor photosensor.

On the other hand, a semiconductor photosensor has low sensitivity at the short wavelength side, as shown in FIG. 33, and cannot easily sense a yellow ink in the case of a color head as compared to other color inks.

In this embodiment, a substrate portion under the heat generating elements and wiring portions except for the logic portion and the transistor portion as semiconductor portions of the head substrate is designed to be a photosensor as a PN junction, thereby forming a detector portion below the almost entire ink surface. Furthermore, by forming pinholes and slits in an aluminum wiring layer, the detector area can be increased without decreasing the wiring resistance.

Figure 34:
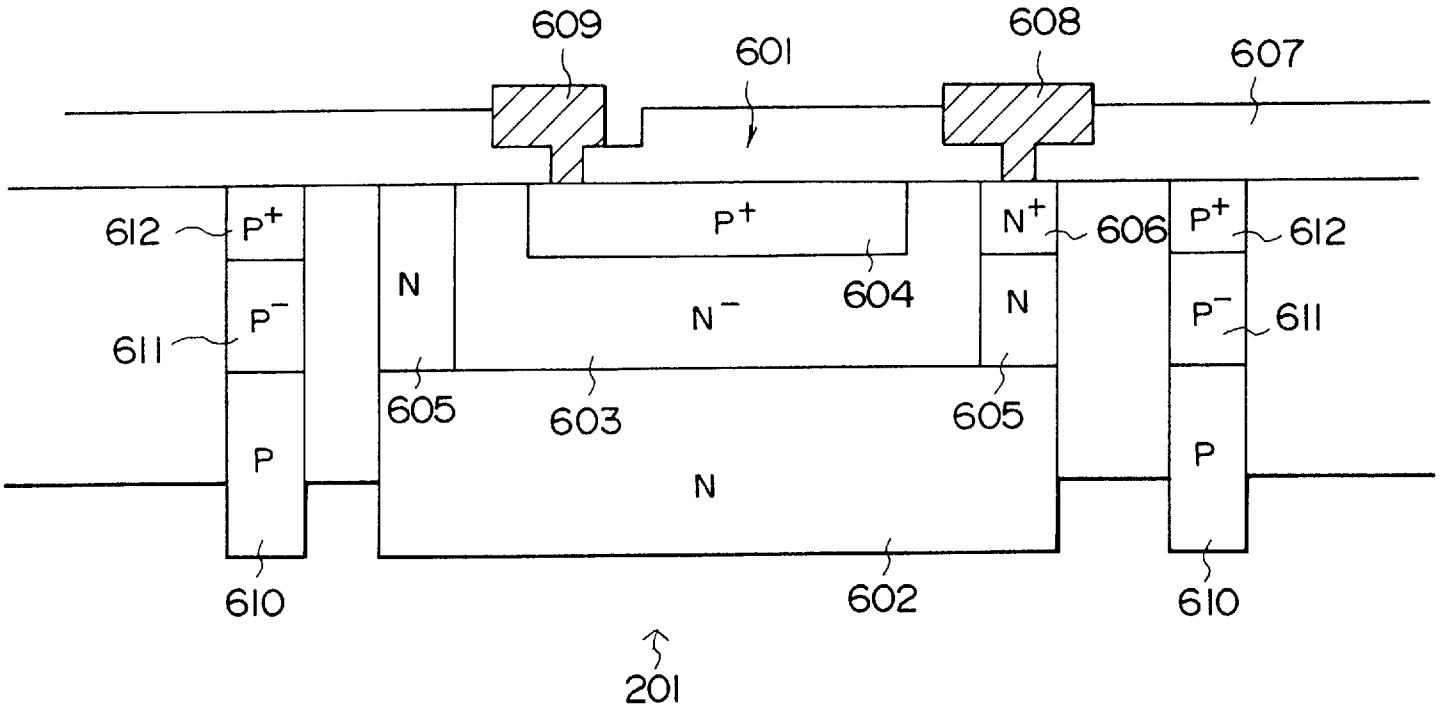
FIG. 34 is a sectional view of the silicon semiconductor photosensor.

FIG. 34 is a sectional view of a conventional photosensor. The photosensor includes a sensor detecting portion 601, an n-type collector buried region 602, an n-type epitaxial region 603, a high-concentration p-type region 604 which serves as the anode of the photosensor, an n-type collector buried region 605, a high-concentration n-type collector buried region 606 which serves as the cathode of the photosensor, an insulating interlayer 607, an aluminum electrode 608 of the cathode, an aluminum electrode 609 of the anode, p-type isolation buried regions 610 and 611 for element isolation, and a high-concentration p-type isolation buried region 612 for element isolation. The detecting portion of the photosensor is a portion around the region 604, where light can reach, and portions below the aluminum electrodes do not serve as a detector.

Figure 35:
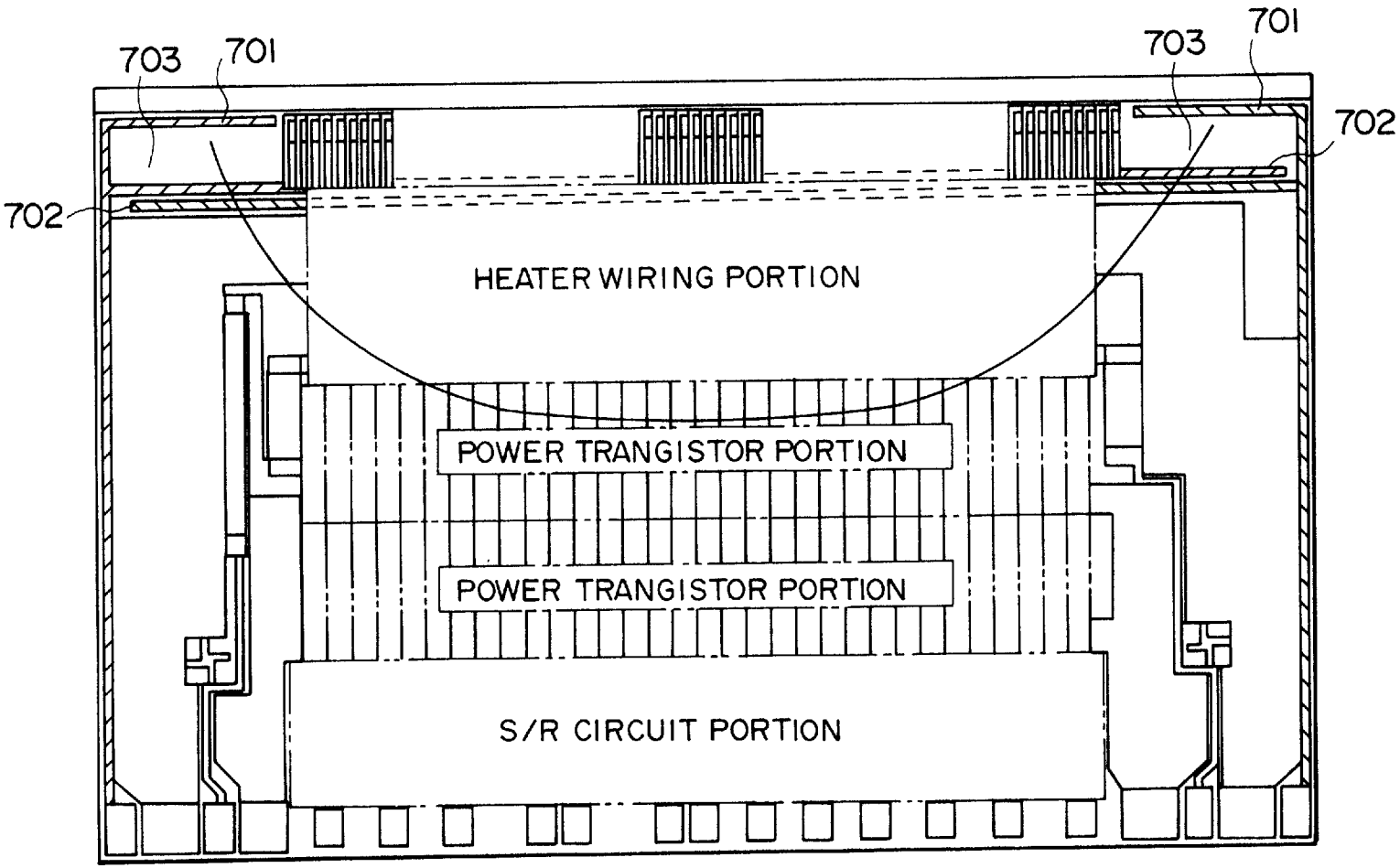
FIG. 35 is a view showing the first embodiment of the layout, in a head board, of an ink sensor according to the present invention.

FIG. 35 shows the layout of the photosensor according to this embodiment on the substrate of the head.

In FIG. 35, aluminum electrodes of anode and cathode electrodes 701 and 702 are constituted by a first aluminum layer. An underlying layer around the electrodes 701 and 702 serves as a PN-junction photosensor, i.e., a detector portion 703. The heat generating elements 404 and the wiring portion 405 for supplying electric power to the heat generating elements are constituted by a second aluminum layer, which crosses over the aluminum electrodes of the photosensor.

Figure 36:
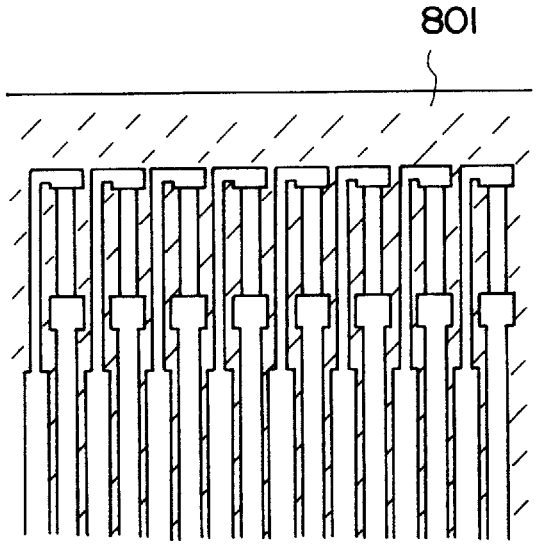
FIG. 36 is a view showing elements around heat generating elements.

Therefore, since the PN-junction portion also extends below the heat generating elements, all hatched portions 801 in FIG. 36 as gaps of the aluminum wiring layer around the heat generating elements serve as detectors of the sensor.

(16th Embodiment)

This embodiment is another embodiment associated with the 15th embodiment.

Figure 37:
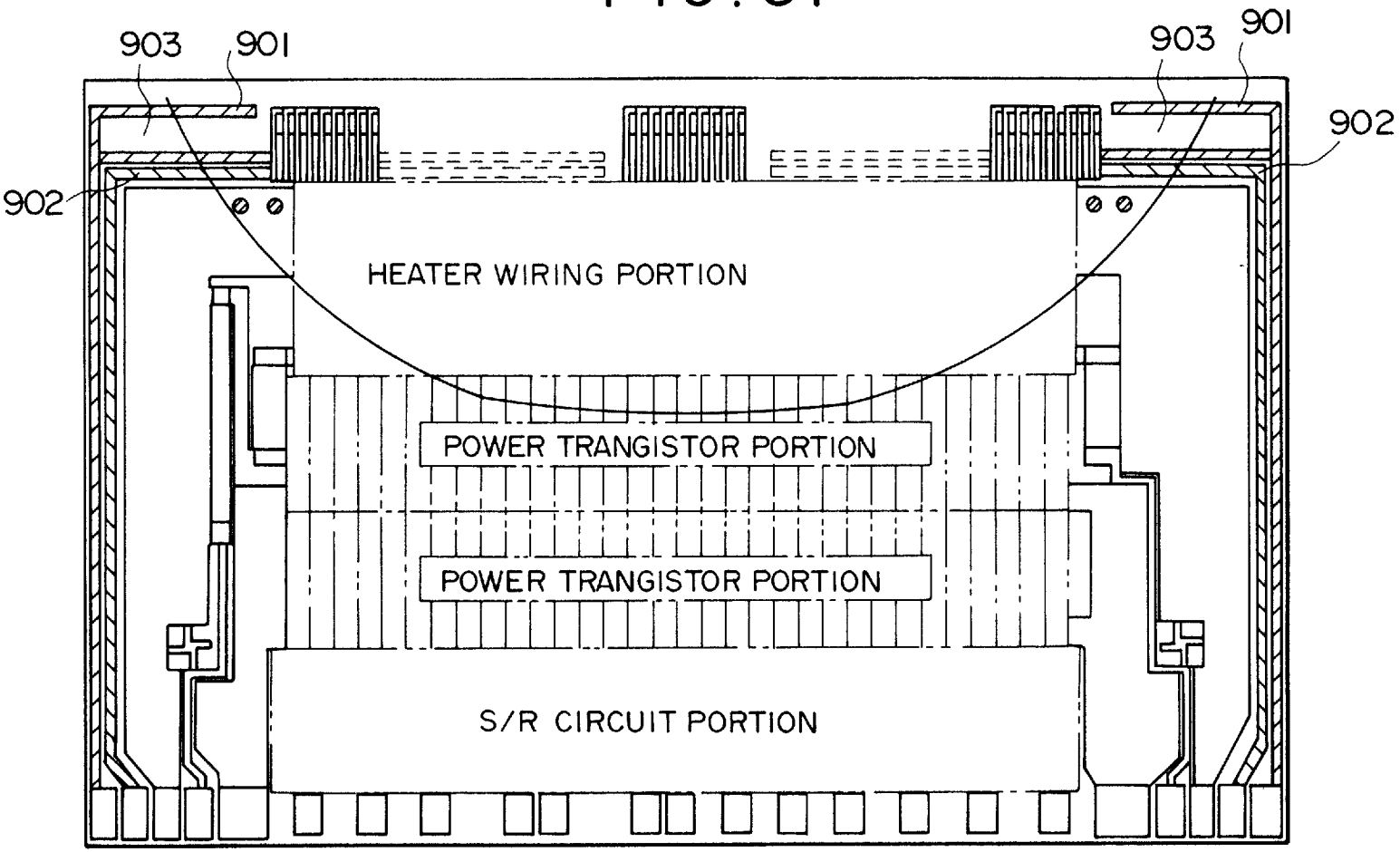
FIG. 37 is a view showing the second embodiment of the layout, in a head board, of an ink sensor according to the present invention.

FIG. 37 shows the layout of the photosensor of this embodiment on the substrate. FIG. 37 illustrates anodes 901, cathodes 902, and detectors 903 of the photosensor. In this embodiment, two, right and left PN junctions are provided to a portion below the heat generating elements as in the above embodiment, and detectors are formed up to the central portion of the discharge ports. Since the two, right and left structures are the same as each other, differential detection can be easily attained, and the distribution of bubbles in the ink chamber can be detected.

Furthermore, in this embodiment, since the PN junctions extend to a position below the VH wiring, the detectors can be formed on the substrate over a wide range by forming holes 904 such as pinholes and slits on the wiring.

Figure 38:
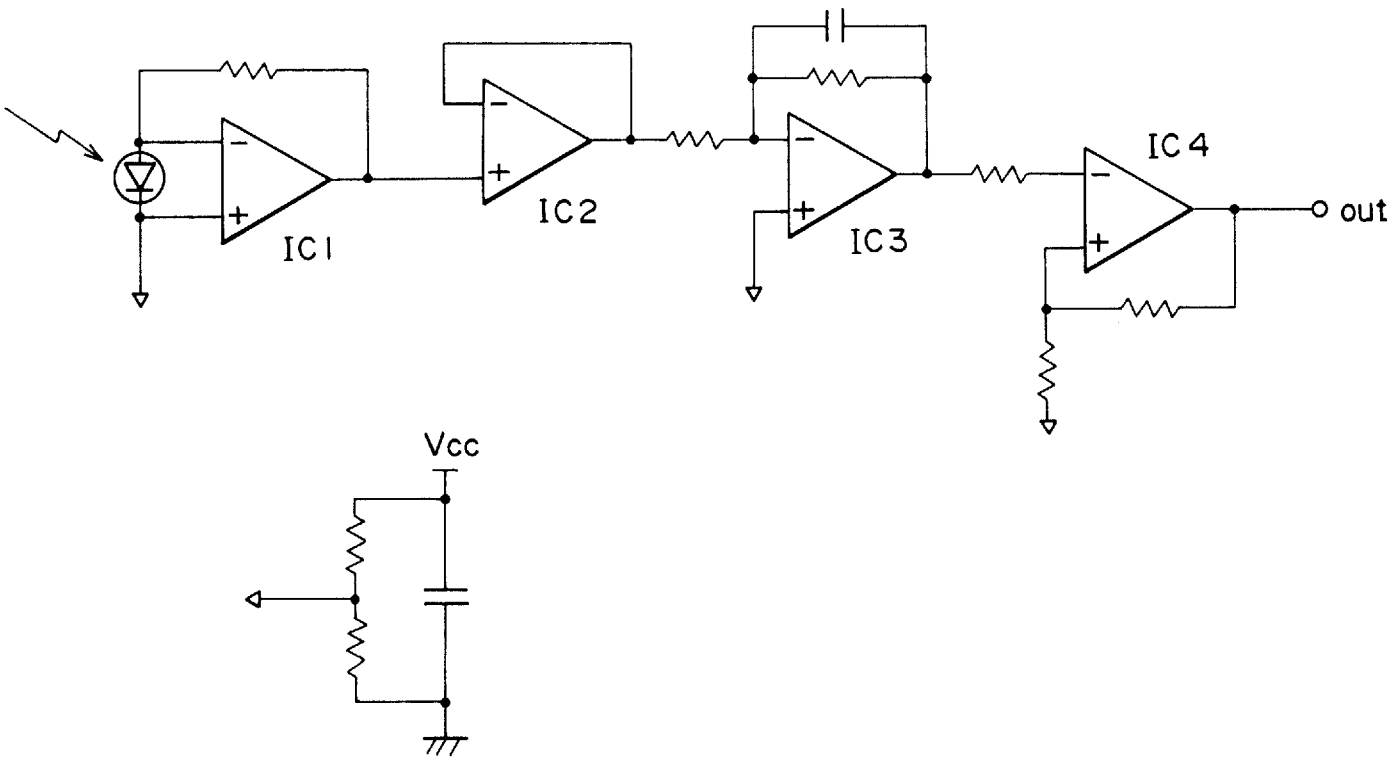
FIG. 38 is a circuit diagram showing an example of a processing circuit.

FIG. 38 shows an example of a processing circuit of the photosensor. Since this processing circuit can be formed in the same manufacturing process as the photosensor and the heat generating element driving transistors, it can be assembled in a head substrate, thus decreasing cost of the printer main body.

A silicon semiconductor photosensor has poor sensitivity in the short wavelength side range from 300 nm to 500 nm where the dye of a yellow ink has absorption, as shown in FIG. 33. Therefore, in the method of this embodiment, the recovery operation of a yellow head must be executed based on sensor information of another head.

In the case of the present invention, an anti-ink protection layer 221 has a multilayered structure, and a portion thereof is formed of low-temperature reflow glass and is colored to absorb short wavelengths. With this structure, when an ink is present, no light is sensed, but when ink shortage occurs, light transmitted through the protection film and having a longer wavelength than that of coloring is detected, thus detecting the yellow ink with a high S/N ratio.

(17th Embodiment)

Figure 39:
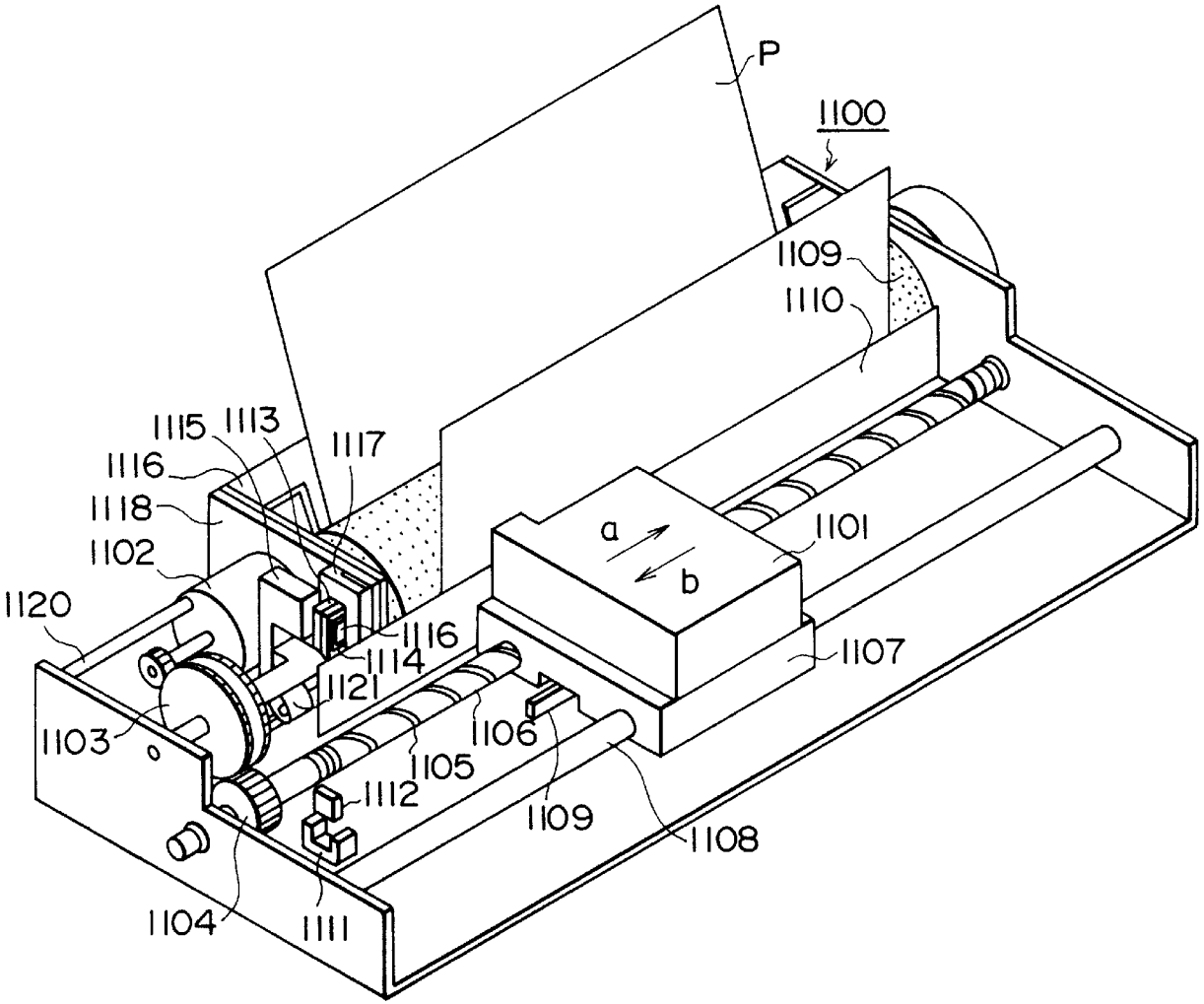
FIG. 39 is a perspective view showing a printer according to the present invention.
Figure 40:
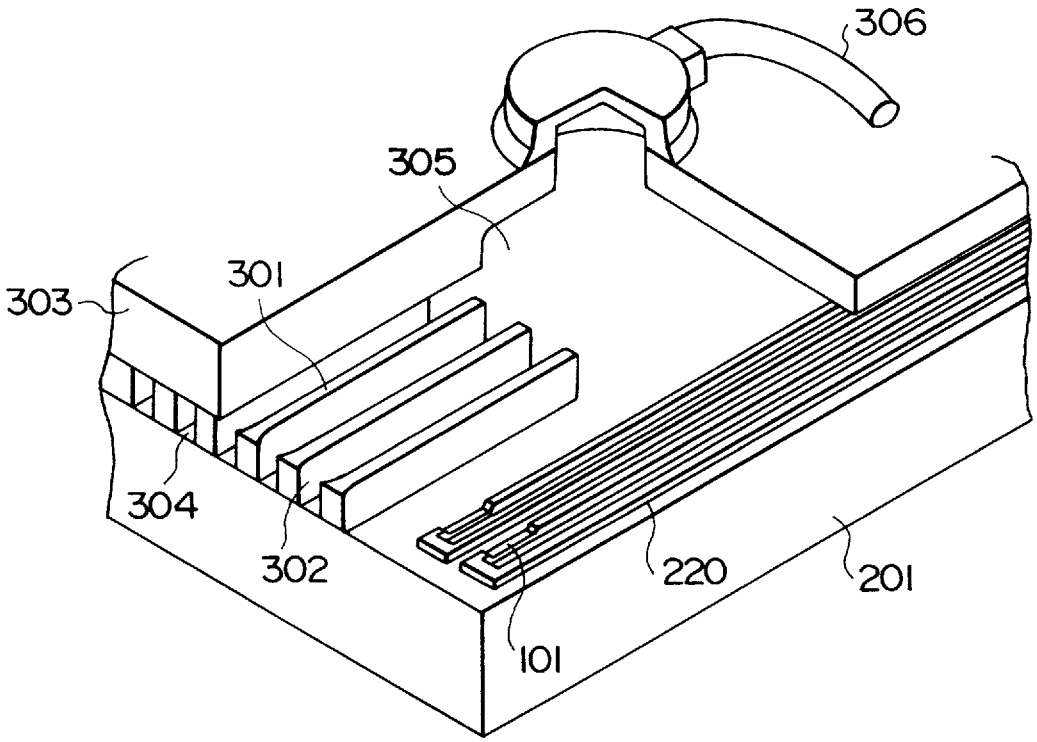
FIG. 40 is a perspective view of a head.
Figure 41:
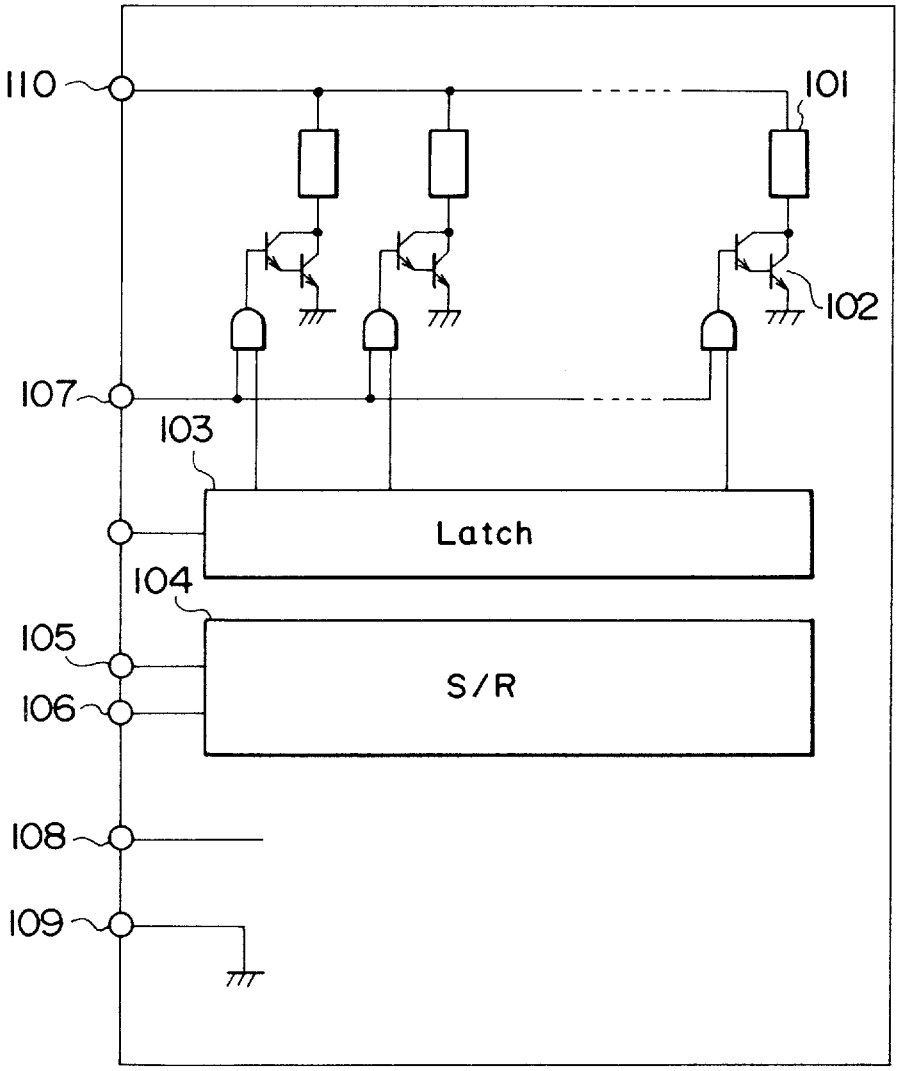
FIG. 41 is a circuit diagram showing an equivalent circuit of a substrate.
Figure 42:
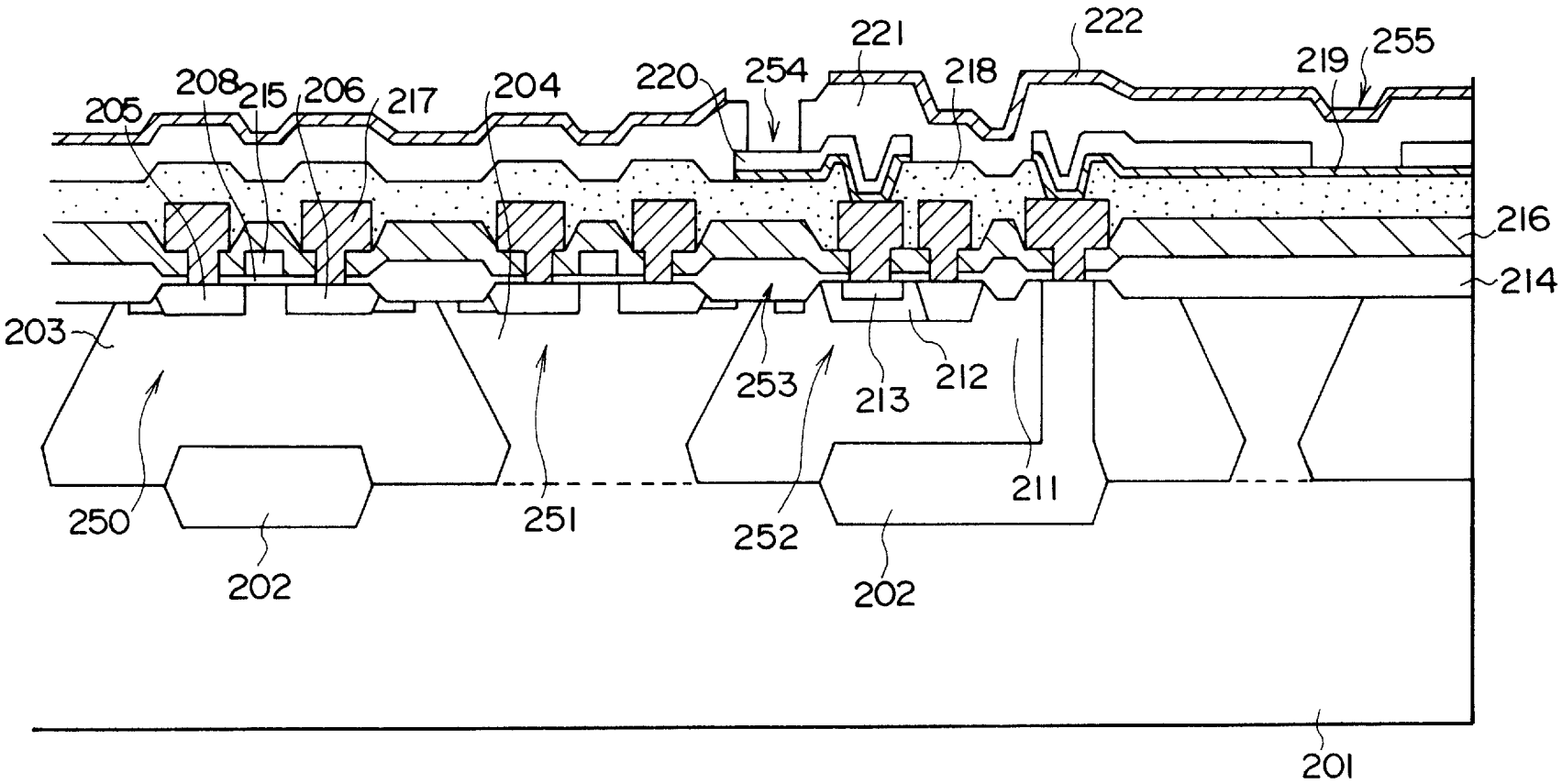
FIG. 42 is a sectional view showing the substrate.

FIG. 39 is a schematic perspective view showing an example of an ink-jet printer to which a print head according to the above embodiment can be attached and applied. A print head 1101 according to the above embodiment is mounted on a carriage 1107, which engages with a spiral groove 1106 of a lead screw 1105 rotated via driving force transmission gears 1103 and 1104 upon forward/reverse rotation of a driving motor 1102. The head 1101 is reciprocally moved in the directions of arrows a and b along a guide 1108 together with the carriage 1107 by the driving force from the driving motor 1102. A paper pressing plate 1110 for a print sheet P, which is conveyed on a platen 1109 by a print medium feed mechanism (not shown), presses the print sheet P against the platen 1109 across the moving direction of the carriage.

Photocouplers 1111 and 1112 are arranged in the vicinity of one end of the lead screw 1105. These photocouplers constitute a home position detecting means which confirms the presence of a lever 1119 of the carriage 1107 in a corresponding region, and performs, e.g., switching of the rotational direction of the driving motor 1102. In FIG. 39, a support member 1113 supports a cap member 1114, which covers the entire surface with discharge ports 304 of the above-mentioned print head 1101. A means 1115 draws an ink by suction from the head 1101 to the interior of the cap member 1114. The suction means 1115 performs suction recovery of the head 1101 via an intra-cap opening portion 1116. A cleaning blade 1117 is movable in the back-and-forth direction (in a direction perpendicular to the moving direction of the carriage 1107) by a movable member 1118, and the blade 1117 and the member 1118 are supported by a main body support plate 1120. A print controller for supplying signals to heat generating members 101 provided to the head 1101 and performing driving control of the above-mentioned mechanisms is arranged on the printer side, and is not shown in FIG. 39.

A printer 1100 with the above-mentioned arrangement performs recording on the print sheet P conveyed on the platen 1109 by a print medium feed mechanism (not shown) by reciprocally moving the head 1101 across the total width of the paper sheet P. Since the head 1101 allows high-density printing, a high-precision print operation can be performed at high speed.

As described above, since the optical element is arranged on the ink discharge control board portion of the recording head, the presence/absence of an ink in the recording head can be detected without increasing cost.

Furthermore, although an ink is present in the ink tank, the ink cannot sometimes be supplied to the recording head due to failures of coupling between the ink tank portion and the recording head portion, leakage of the flow path portion, and the like. Such an error can be detected.

Moreover, the density of an ink to be discharged is detected, and a failure such as deterioration of an ink due to, e.g., aging, and an insertion error of a wrong ink tank in a recording apparatus with an exchangeable ink tank can be detected.

In addition, the sensor is an optical sensor, and a light emitting element is also arranged on the ink discharge control board in addition to the sensor, thus improving detection precision.

Also, the temperature of the recording head can be measured at the same time.

Furthermore, the sensor can also be commonly used as a home position sensor and a sheet sensor.

Moreover, registration correction of a recording head unit including a plurality of heads can be attained.

In the 15th and 16th embodiments, although the detector portion of the photosensor in the ink-jet print head substrate with 64 segments at an element density of 360 dpi can only have an area as small as about 0.1 $mm^2$, the area of the detector portion can be increased to 1.0 $mm^2$ or more according to these embodiments without increasing the chip size. Since the area of the detector portion is increased 10 times or more, the S/N ratio of the sensor can be improved 10 times or more.

As a result, since automatic recovery of an ink need not periodically performed, the amount of ink consumed in the recovery operation can be remarkably decreased, and the running cost of the head is lowered. For example, when five sheets per day were printed using an ink-jet head BC-01 (trade name; available from CANON INC.), and a periodic recovery operation was performed once per several days, 450 sheets could be printed for about 90 days. However, according to the method of the present invention, 500 sheets could be printed for 100 days, and the running cost was lowered in correspondence with an increase in the number of printed sheets.

Furthermore, since the amount of ink drawn by suction in the recovery operation becomes small, the ink tank of the printer apparatus main body can be reduced in size, thus achieving a compact, lightweight structure.

Since the sensor and the processing circuit for the sensor are arranged on an extra space on the board in the same process as the head board formation, cost can be reduced by that for the sensor processing circuit in the printer main body without increasing the cost of the head.

Furthermore, a conventional semiconductor sensor cannot easily detect a yellow ink. However, by coloring a PSG layer of the protection layer in a yellow system and selecting a proper light source, bubbles in the yellow ink can be detected at a practical level.

What is claimed is:

1. An ink-jet head for performing recording by discharging an ink, comprising:

a discharge port for discharging the ink;

an ink channel which communicates with said discharge port and is provided with a discharge energy generating element for discharging the ink; and a substrate on which said discharge energy generating element is disposed, wherein an optical element comprising at least one of a light emitting portion for performing transmission of light and a light receiving portion for performing reception of light is arranged at a position on said substrate corresponding to said ink channel, of said ink-jet head.

2. An ink-jet head according to claim 1, wherein said discharge energy generating element comprises a heat generating element arranged on a substrate in correspondence with said ink channel.

3. An ink-jet head according to claim 1, wherein said optical element is arranged at a position corresponding to a common ink chamber constituting the ink channel.

4. An ink-jet head according to claim 1, wherein said optical element is arranged in an ink fine flow path constituting said ink channel.

5. An ink-jet head according to claim 1, wherein said ink-jet head is connected to an ink tank.

6. An ink-jet head according to claim 5, wherein the ink is contained in the ink tank.

7. An ink-jet head according to claim 1, further comprising an amplifying circuit for amplifying a signal output by light reception of said light receiving element, and wherein said amplifying circuit is provided on said substrate.

8. An ink-jet apparatus for performing recording by discharging an ink, comprising:

an ink-jet head for performing recording by discharging an ink, comprising;

a discharge port for discharging the ink;

an ink channel which communicates with said discharge port and is provided with a discharge energy generating element for discharging the ink, and a substrate on which said discharge energy generating element is disposed, wherein an optical element comprising at least one of a light emitting portion for performing transmission of light and a light receiving portion for performing reception of light is arranged at a position on said substrate corresponding to said ink channel, of said ink-jet head; and control means for performing at least one of an ink remaining amount detection, an ink density detection, a home position detection, a recording medium presence/absence detection, a head temperature detection, and a recording medium width detection based on an output from said optical element.

9. An ink-jet apparatus according to claim 8, wherein said discharge energy generating element comprises a heat generating element arranged on a substrate in correspondence with said ink channel.

10. An ink-jet apparatus according to claim 8, wherein said optical element also serves as a temperature detection element.

11. An ink-jet apparatus according to claim 8, wherein said optical element is arranged at a position corresponding to a common ink chamber constituting the ink channel.

12. An ink-jet apparatus according to claim 8, wherein said optical element is arranged in an ink fine flow path constituting said ink channel.

13. A substrate for an ink-jet head, comprising:

a discharge energy generating element for discharging an ink disposed on said substrate;

a wiring electrode electrically connected to said discharge energy generating element disposed on said substrate; and an optical element arranged on said substrate comprising at least one of a light emitting portion for performing transmission of light and a light receiving portion for performing reception of light.

14. A substrate according to claim 13, wherein said discharge energy generating element comprises a heat generating element.

15. A substrate according to claim 13, wherein said optical element is an element formed by a PN junction formed below a peripheral portion where said wiring electrode is formed.

16. An ink-jet recording apparatus according to any of claims 8 and 9, 10 and 12, further comprising a plurality of said ink jet heads, and wherein said plurality of said ink-jet heads are arranged in correspondence with ink colors.

* * * * *

UNITED STATES PATENT AND TRADEMARK OFFICE

CERTIFICATE OF CORRECTION

PATENT NO. : 5,841,448

DATED : November 24, 1998

INVENTOR(S) : JIRO MORIYAMA ET AL.

It is certified that error appears in the above-identified patent and that said Letters Patent is hereby corrected as shown below:

IN THE DRAWINGS

Sheet 21, figure 32, "TRANGISTOR" (both occurrences) should read --TRANSISTOR--;
Sheet 24, figure 35, "TRANGISTOR" (both occurrences) should read --TRANSISTOR--; and
Sheet 26, figure 37, "TRANGISTOR" (both occurrences) should read --TRANSISTOR--.

COLUMN 3

Line 40, "detects" should read --which detects--; and
Line 46, "sufficiently" should read --sufficient--.

COLUMN 10

Line 54, "not" should read --to--.

UNITED STATES PATENT AND TRADEMARK OFFICE

CERTIFICATE OF CORRECTION

PATENT NO. : 5,841,448

DATED : November 24, 1998

INVENTOR(S) : JIRO MORIYAMA ET AL.

It is certified that error appears in the above-identified patent and that said Letters Patent is hereby corrected as shown below:

COLUMN 22

Line 4, "8 and 9, 10 and 12," should read --9 to 12,--.

Signed and Sealed this

Eleventh Day of January, 2000

*Attest:*

Q. TODD DICKINSON

*Attesting Officer*

*Acting Commissioner of Patents and Trademarks*